US005134050A

United States Patent [19]

Eto et al.

[11] Patent Number: 5,134,050

[45] Date of Patent: Jul. 28, 1992

[54] PHOTORECEPTOR COMPRISING THE COMBINED USE OF A QUINONE AND AZO COMPOUND AS CHARGE GENERATING MATERIALS

[75] Inventors: Yoshihiko Eto; Yoshiaki Takei, both of Hachioji, Japan

[73] Assignee: Konica Corporation, Tokyo, Japan

[21] Appl. No.: 546,028

[22] Filed: Jun. 28, 1990

[30] Foreign Application Priority Data

Jun. 30, 1989 [JP] Japan ..... 1-168601

[51] Int. Cl.[5] ..... G03G 15/02

[52] U.S. Cl. ..... 430/59; 430/70; 430/58

[58] Field of Search ..... 430/59, 58, 70

[56] References Cited

U.S. PATENT DOCUMENTS 4,891,288 1/1990 Fujimaki et al. ..... 430/59

4,939,058 7/1990 Shibata et al. ..... 430/58

*Primary Examiner*—Marion E. McCamish

*Assistant Examiner*—S. Rosasco

*Attorney, Agent, or Firm*—Jordan B. Bierman

[57] ABSTRACT

The improved photoreceptor has a light-sensitive layer that contains as carrier generation materials both a polycylic quinone compound selected from among specified anthanthrone pigments, dibenzpyrene pigments and pyranthrone pigments and a specified bisazo pigment, and that also contains a specified stilbene compound as a carrier transport material. This photoreceptor has good spectral sensitivity characteristics over a broad range of wavelengths, has high sensitivity, has a long cycle life on account of reduced residual potential, is adapted for fast copying processes, and is capable of copying red images with improved fidelity of reproduction.

15 Claims, 2 Drawing Sheets

PHOTORECEPTOR COMPRISING THE COMBINED USE OF A QUINONE AND AZO COMPOUND AS CHARGE GENERATING MATERIALS

BACKGROUND OF THE INVENTION

This invention relates to a photoreceptor, particularly to an electrophotographic photoreceptor Inorganic photoconductive materials including selenium, zinc oxide, titanium oxide and cadmium sulfide have conventionally been used as light-sensitive materials in electrophotographic photoreceptors. Active R&D efforts have recently been made on amorphous silicon.

Organic photoconductive materials (OPC) are also usable as light-sensitive materials and increasing attention is being paid to OPCs since they are generally less toxic than inorganic photoconductive materials and since they are more advantageous in such aspects as flexibility, lightweightness, film-forming property and cost.

Whichever type of light-sensitive materials are used in electrophotographic photoreceptors, "functionally separated" photoreceptors in which different materials are used in two layers for fulfilling separate functions of charge generation and charge transport have the advantage that the two functions can be performed independently of each other, whereby greater latitude in photoreceptor design can be attained. Another advantage of "functionally separated photoreceptors" is that they have improved electrophotographic characteristics such as high sensitivity, long cycle life and good mechanical strength.

Such electrophotographic photoreceptors are extensively used in electrophotographic copiers, printers, etc. As recent models of electrophotographic copiers and printers are operated at faster speeds, the time required for copying processes is significantly shortened and at the same time, the number of copying cycles increases so much as to require the use of more sensitive and durable photoreceptors.

Polycyclic quinone compounds and azo pigments may be shown as typical examples of high-sensitivity carrier generating materials that are suitable for use in electrophotographic photoreceptors. White light sources such as an A light source and a fluorescent lamp are commonly employed with electrophotographic copiers and the photoreceptor is illuminated with light having wavelengths over the entire visible range. Polycyclic quinone compounds have excellent photocarrier generating ability but their spectral sensitivity is limited to the range of 400–570 nm. Hence, using polycyclic quinone compounds, it is difficult to fabricate electrophotographic photoreceptors having sensitivity to light at wavelengths longer than 570 nm. On the other hand, photoreceptors using azo pigments, for example, disazo pigments, have their spectral sensitivity extended to nearly 700 nm but their photosensitivity is low on the shorter wavelength side. Therefore, it is also difficult to fabricate photoreceptors with higher sensitivity using azo pigments.

A more important problem arises from the fact that electrophotographic copiers which are indispensable to everyday work in business offices, governmental agencies, public organizations, etc. are required to achieve faithful reproductions of original documents, particularly seals affixed to various documents and underlines marked in red. To meet this need for faithful reproduction of red images, the carrier generating materials used should not have any sensitivity in the wavelength range beyond 600 nm or they must have such a spectral sensitivity characteristic that the sensitivity in this longer wavelength range is lower than in the other ranges. However, the carrier generation materials available today have their own spectral sensitivity characteristics and it is considerably difficult to find carrier generating materials that have satisfactory electrophotographic characteristics and which yet are capable of reproducing red originals to a degree that suits the specific purpose of a copying operation.

With a view to improving the reproducibility of red color, it has been proposed that a red cutting cyan filter be inserted into the optical path of white light. However, if light at wavelengths longer than 600 nm is cut when disazo pigments are used, a substantial decrease in light sensitivity occurs.

As described above, prior art photoreceptors do not have sufficient light sensitivity and red color reproducibility to be adapted for use with high-speed electrophotographic copiers and small copiers and the advent of photoreceptors having higher sensitivity has been desired.

SUMMARY OF THE INVENTION

An object, therefore, of the present invention is to provide a photoreceptor that has good spectral sensitivity characteristics over a broad range of wavelengths, that has high sensitivity, that has a long cycle life on account of reduced residual potential, that is adapted for fast copying processes, and that is capable of copying red images with improved fidelity of reproduction.

The present inventors conducted intensive studies in order to attain the above-stated object and found that it could be attained by a photoreceptor having a light-sensitive layer that contains as carrier generation materials a polycyclic quinone compound represented by the following general formula (A), (B) or (C) and a compound represented by the following general formula (I) and that also contains a compound represented by the following general formula (ii) as a carrier transport material:

(A)

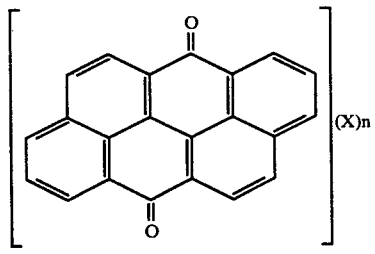

(B)

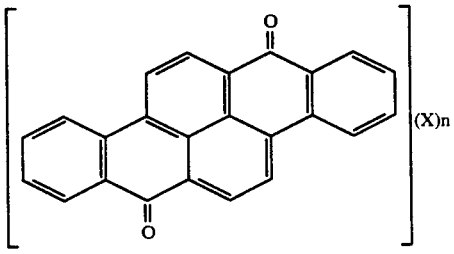

-continued (C)

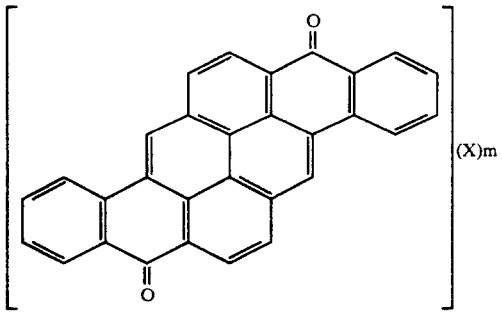

(where X is a halogen atom, a nitro group, a cyano group, an acyl group of a carboxyl group; n is an integer of 0–4; and m is an integer of 0–6);

[I]

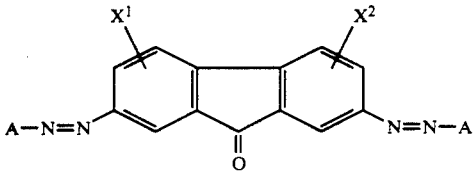

(where $X^1$ and $X^2$ independently are a hydrogen atom or a halogen atom, provided that $X^1$ and $X^2$ are not simultaneously a hydrogen atom; A is a group represented by formula [P];

[P]

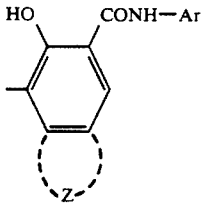

(wherein Ar is an aromatic hydrocarbon ring having a fluorinated hydrocarbon group or an aromatic heterocyclic group having a fluorinated hydrocarbon group; Z is a group of non-metal atoms necessary to complete a substituted or unsubstituted aromatic group or a substituted or unsubstituted aromatic heterocyclic group);

(II)

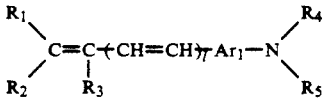

(where $R_1$ is a substituted or unsubstituted aryl or styryl group; $R_2$ is a hydrogen atom, a substituted or unsubstituted alkyl grbup, a substituted or unsubstituted aryl group or a substituted or unsubstituted styryl group, provided that $R_1$ and $R_2$ may combine together to form a ring; $Ar_1$ is a substituted or unsubstituted arylene group; $R_3$, $R_4$ and $R_5$ are each independently a hydrogen atom, a substituted or unsubstituted alkyl group, a substituted or unsubstituted aryl group or a substituted or unsubstituted styryl group; l is an integer of 0 or 1, provided that when l=0 and $R_1$ is a substituted or unsubstituted aryl group, $R_2$ is a substituted or unsubstituted alkyl group, a substituted or unsubstituted aryl group or a substituted or unsubstituted styryl group).

DETAILED DESCRIPTION OF THE INVENTION

The present invention is described below in detail. The photoreceptor of the present invention is characterized by using a light-sensitive layer that contains as carrier generation materials a polycyclic quinone compound represented by the general formula (A), (B) or (C) and a compound represented by the general formula (I) and that also contains a compound represented by the general formula (II) as a carrier transport material.

Figure 1:
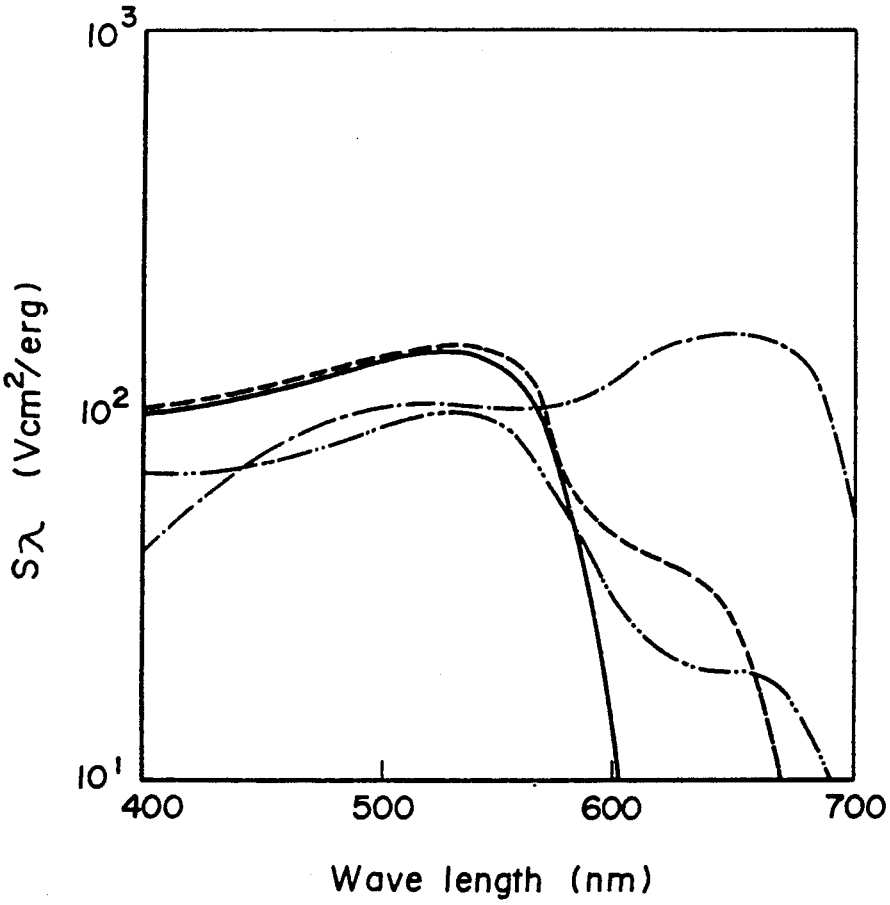
FIG. 1 is a graph showing the spectral sensitivity curves of various carrier generation materials.
Figure 2:
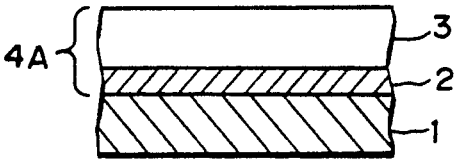
FIGS. 2–7 are cross-sectional views showing schematically six examples of the photoreceptor of the present invention.
Figure 3:
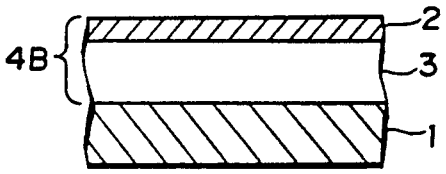

A polycyclic quinone compound such as 4,10-dibromoanthanthrone has the spectral sensitivity curve shown by the solid line in FIG. 1 and is sensitive to light in the wavelength of 400–570 nm. Such polycyclic quinone compounds have particularly high levels of light sensitivity among various materials but as already mentioned above, they themselves do not have sensitivity in the longer wavelength range and the improvement in light sensitivity is not necessarily sufficient to permit efficient operation of high-speed copiers.

To deal with this problem, sensitivity to the longer wavelength range may be imparted by using polycyclic quinone compounds in combination with other carrier generation materials but depending on the type of carrier generation materials that are combined with polycyclic quinone compounds, their own sensitivity to light in the shorter wavelength range may be impaired. Further, there is no established criterion for selecting appropriate carrier generation materials and the actual method used today is empirical in that a suitable compound is selected from a great number of choices on a trial-and-error basis. Another problem is that satisfactory reproduction of red color cannot be achieved if the sensitivity to light at wavelengths longer than 600 nm is unduly increased.

As a result of the intensive studies conducted to solve these problems, the present inventors found that satisfactory results could be attained by using a polycyclic quinone compound of the general formula (A), (B) or (C) and a compound of the general formula (I) as carrier generation materials and by using a compound of the general formula (II) as a carrier transport material.

A compound represented by the general formula (I), say, azo compound No. 71 to be listed below, has the spectral sensitivity curve shown by the one-long-and-one-short dashed line in FIG. 1. When this compound was used in combination with a polycyclic quinone compound of the general formula (A), (B) or (C) at a weight ratio of 5:100, sensitivity to light at wavelengths longer than 570 nm was imparted and the inherent light sensitivity of the polycyclic quinone compound was retained whereas the sensitivity to red light having wavelengths longer than 600 nm could be held low (see the sensitivity curve shown by the dashed line in FIG. 1). This contributed to the fabrication of a practical photoreceptor that was adaptive to high-speed copying processes, that had a long cycle life and that yet was capable of reproducing red images.

When a comparative azo compound was used in combination with 4,10-dibromoanthanthrone at a weight ratio of 5:100 (sample No. 8 in Example 1 to be described hereinafter), a substantial drop in sensitivity occurred as indicated by the one-long-and-two-short dashed line in FIG. 1.

The present invention has the added advantage that even if the light-sensitive layer that contains a polycyclic quinone compound of the general formula (A), (B) or (C) and a compound of the general formula (I) as carrier generation materials is comparatively thick, the resulting photoreceptor has satisfactory characteristics and can be produced without involving any coating defects such as uneven step coverage, sagging and agglomeration.

The specific embodiment of the present invention is described below. The proportions of the polycyclic quinone compound of the general formula (A), (B) or (C) and the compound of the general formula (I) in the light-sensitive layer are preferably such that the weight ratio of the polycyclic quinone compound to the compound (I) is in the range of from 100:1 to 100:100, with the range of 100:1 to 100:20 being more preferred since further improvements can be achieved in terms of red color reproduction and light sensitivity.

When a maximum spectral sensitivity at a wavelength ($\lambda$) of 600 nm and below is written as Qmax ($\lambda \leqq 600$ nm) and if a maximum spectral sensitivity at $\lambda$ of 600 nm and above is written as Qmax ($\lambda \geqq 600$ nm), the ratio of Qmax ($\lambda \leqq 600$ nm) to Qmax ( $\geqq 600$ nm) is preferably not higher than 100:50 for the purpose of achieving even better reproduction of red color.

Examples of the halogen atom represented by $X^1$ and $X^2$ in the general formula (I) include chlorine, bromine, fluorine and iodine atoms. The bisazo compound of the present invention is such that at least one of $X^1$ and $X^2$ is a halogen atom.

In the general formula (I), A is represented by the following general formula (P):

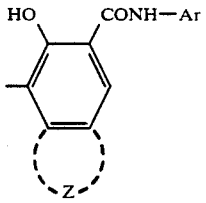

(P)

where Ar is an aromatic carbocyclic or heterocyclic group having at least one fluorinated hydrocarbon group. The fluorinated hydrocarbon group preferably contains 1–4 carbon atoms and may be exemplified by a trifluoromethyl group, a pentafluoroethyl group, a tetrafluoroethyl group and a heptafluoropropyl group. A particularly preferred fluorinated hydrocarbon group is a trifluoromethyl group. Exemplary aromatic carbocyclic groups include phenyl, naphthyl and anthryl groups, a preferred aromatic carbocyclic group being a phenyl group. Exemplary aromatic heterocyclic groups include carbazolyl and dibenzofuryl groups. Substituents other than the fluorinated hydrocarbon group in the aromatic carbo-cyclic and heterocyclic groups include: substituted or unsubstituted alkyl groups having 1–4 carbon atoms such as methyl, ethyl, isopropyl, t-butyl and trifluoromethyl groups; substituted or unsubstituted aralkyl groups such as benzyl and phenethyl groups; halogen atoms such as chlorine, bromine, fluorine and iodine atoms; substituted or unsubstituted alkoxy groups having 1–4 carbon atoms such as methoxy, ethoxy, isopropoxy, t-butoxy and 2-chloroethyoxy groups; a hydroxy group; substituted or unsubstituted aryloxy groups such as p-chlorophenoxy and 1-naphtyoxy groups; acyloxy groups such as acetyloxy and p-cyanobenzoyloxy groups; carboxyl groups and esters thereof such as ethoxycarbonyl and m-bromophenoxycarbonyl groups; carbamoyl groups such as aminocarbonyl, t-butylaminocarbonyl and anilinocarbonyl groups; acyl groups such as acetyl and o-nitrobenzoyl groups; sulfo and sulfamoyl groups such as aminosulfonyl, t-butylaminosulfonyl and p-tolylaminosulfonyl groups; amino and acylamino groups such as acetylamino and benzoylamino groups; sulfonamido groups such as methanesulfonamido and p-toluenesulfonamido groups; a cyano group; and a nitro group. Among these substituents, the following are preferred: substituted or unsubstituted alkyl groups having 1–4 carbon atoms such as methyl, ethyl, isopropyl, t-butyl and trifluoromethyl groups; halogen atoms such as chlorine, bromine, fluorine and iodine atoms; substituted or unsubstituted alkoxy groups having 1–4 carbon atoms such as methoxy, ethoxy, t-butoxy and 2-chloroethoxy groups; a nitro group; and a cyano group.

In the general formula (P), Z represents the atomic group necessary to form a substituted or unsubstituted aromatic carbon ring or a substituted or unsubstituted aromatic hetero ring, and more specifically, Z represents the atomic group necessary to form a substituted or unsubstituted benzene ring, a substituted or unsubstituted naphthalene ring, a substituted or unsubstituted indole ring or a substituted or unsubstituted carbazole ring. The substituent on the atomic group necessary to form these rings may be exemplified by those which are listed above as substituents on Ar, and preferred examples include halogen atoms (e.g. Cl, Br, F and I atoms), a sulfo group, and sulfamoyl groups (e.g. aminosulfonyl and p-tolylaminosulfonyl).

The bisazo compound represented by the general formula (I) is preferably represented by the following general formula (III) or (IV):

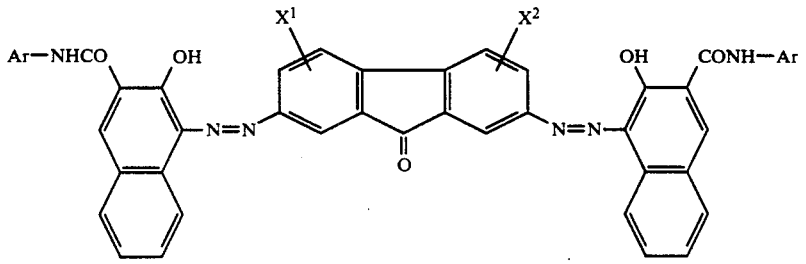

(III)

-continued

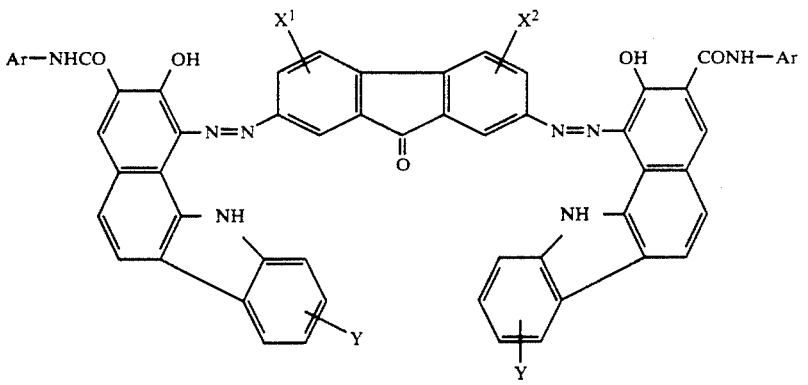

(IV)

In these formulas, $X^1$ and $X^2$ respectively have the same meanings as $X^1$ and $X^2$ in the general formula (I), and Ar and Y also have the same meanings as Ar and the substituent on Z in the general formula (P).

Exemplary compounds

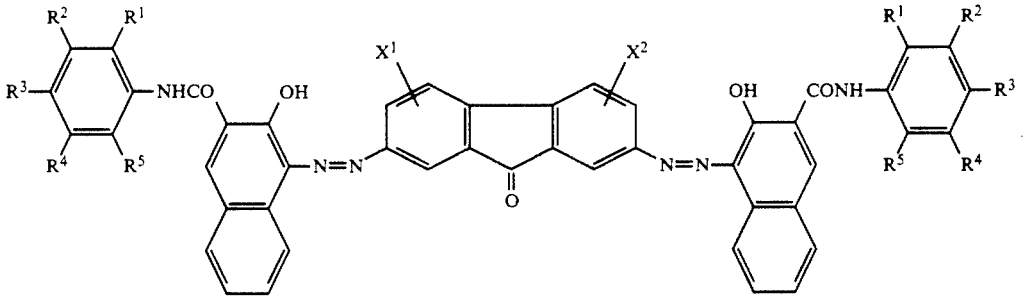

| No. | $X^1$ | $X^2$ | $R^1$ | $R^2$ | $R^3$ | $R^4$ | $R^5$ |
|---|---|---|---|---|---|---|---|
| 1 | 4-F | H | H | $CF_3$ | H | H | H |
| 2 | 4-F | H | H | H | $CF_3$ | H | H |
| 3 | 4-F | H | $CF_3$ | H | H | H | H |
| 4 | 4-F | H | Cl | H | H | $CF_3$ | H |
| 5 | 4-F | H | H | $C_2F_5$ | H | H | H |
| 6 | 4-F | H | H | $C_2F_5$(n) | H | H | H |
| 7 | 4-F | H | H | $C_2F_4H$ | H | H | H |
| 8 | 4-F | H | H | $CF_3$ | Cl | H | H |
| 9 | 4-F | H | Br | H | H | $CF_3$ | H |
| 10 | 4-F | H | $CF_3$ | H | H | $CF_3$ | H |
| 11 | 4-F | 5-F | H | $CF_3$ | H | H | H |
| 12 | 4-F | 5-F | H | H | $CF_3$ | H | H |
| 13 | 4-F | 5-F | Cl | H | H | $CF_3$ | H |
| 14 | 3-F | 5-F | H | $CF_3$ | H | H | H |
| 15 | 3-F | 5-F | H | H | $CF_3$ | H | H |
| 16 | 1-F | 5-F | H | $CF_3$ | H | H | H |
| 17 | 3-F | 5-F | H | $CF_3$ | H | H | H |
| 18 | 3-F | 5-F | $CF_3$ | H | H | H | H |
| 19 | 3-F | 5-F | H | H | $CF_3$ | H | H |
| 20 | 3-F | 5-F | Cl | H | H | $CF_3$ | H |
| 21 | 3-F | 6-F | H | $CF_3$ | H | H | H |
| 22 | 3-F | 6-F | H | H | $CF_3$ | $CF_3$ | H |
| 23 | 3-F | 6-F | Cl | H | H | H | H |
| 24 | 3-Cl | 5-F | H | $CF_3$ | H | H | H |
| 25 | 3-F | 6-Cl | H | $CF_3$ | H | H | H |
| 26 | 3-F | 6-Br | H | $CF_3$ | H | H | H |
| 27 | 4-Cl | H | H | $CF_3$ | H | H | H |
| 28 | 4-Cl | H | H | H | $CF_3$ | H | H |
| 29 | 4-Cl | H | $CF_3$ | H | H | H | H |
| 30 | 4-Cl | H | Cl | H | H | $CF_3$ | H |
| 31 | 4-Cl | H | H | $C_2F_5$ | H | H | H |
| 32 | 4-Cl | H | H | $C_3H_7$(n) | H | H | H |
| 33 | 4-Cl | H | H | $C_2F_4H$ | H | H | H |
| 34 | 4-Cl | H | H | $CF_3$ | Cl | H | H |
| 35 | 4-Cl | H | Br | H | H | $CF_3$ | H |
| 36 | 4-Cl | H | $CF_3$ | H | H | $CF_3$ | H |
| 37 | 4-Cl | 5-Cl | H | $CF_3$ | H | H | H |
| 38 | 4-Cl | 5-Cl | H | $CF_3$ | $CF_3$ | H | H |
| 39 | 4-Cl | 5-Cl | Cl | H | H | $CF_3$ | H |
| 40 | 3-Cl | 5-Cl | H | $CF_3$ | H | H | H |

-continued

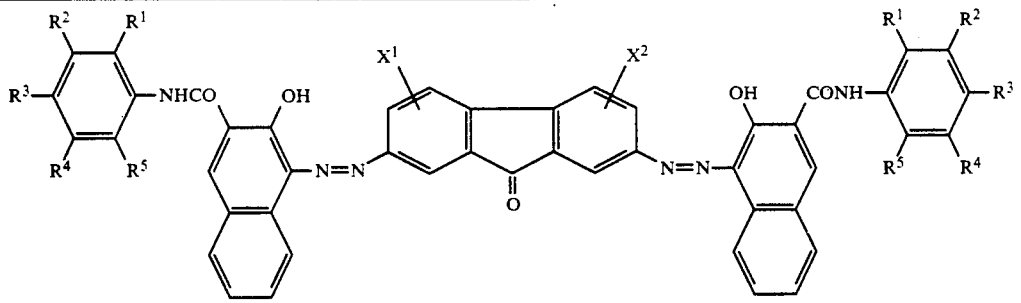

| No. | $X^1$ | $X^2$ | $R^1$ | $R^2$ | $R^3$ | $R^4$ | $R^5$ |
|---|---|---|---|---|---|---|---|
| 41 | 3-Cl | 5-Cl | H | H | $CF_3$ | H | H |
| 42 | 4-Cl | 5-Cl | H | $CF_3$ | H | H | H |
| 43 | 3-Cl | H | H | $CF_3$ | H | H | H |
| 44 | 3-Cl | H | $CF_3$ | H | H | H | H |
| 45 | 3-Cl | H | H | H | $CF_3$ | H | H |
| 46 | 3-Cl | H | Cl | H | H | $CF_3$ | H |
| 47 | 3-Cl | 6-Cl | H | $CF_3$ | H | H | H |
| 48 | 3-Cl | 6-Cl | H | H | $CF_3$ | H | H |
| 49 | 3-Cl | 6-Cl | Cl | H | H | $CF_3$ | H |
| 50 | 3-Cl | 6-Cl | H | $CF_3$ | H | H | H |
| 51 | 3-F | 5-Cl | H | $CF_3$ | H | H | H |
| 52 | 3-Cl | 6-F | H | $CF_3$ | H | H | H |
| 53 | 3-Cl | 6-Br | H | $CF_3$ | H | H | H |
| 54 | 4-Br | H | H | $CF_3$ | H | H | H |
| 55 | 4-Br | H | H | H | $CF_3$ | H | H |
| 56 | 4-Br | H | $CF_3$ | H | H | H | H |
| 57 | 4-Br | H | Cl | H | H | $CF_3$ | H |
| 58 | 4-Br | H | H | $C_2F_5$ | H | H | H |
| 59 | 4-Br | H | H | $C_3F_5$(n) | H | H | H |
| 60 | 4-Br | H | H | $C_2F_4H$ | H | H | H |
| 61 | 4-Br | H | H | $CF_3$ | Cl | H | H |
| 62 | 4-Br | H | Br | $CF_3$ | H | H | H |
| 63 | 4-Br | H | $CF_3$ | H | H | $CF_3$ | H |
| 64 | 4-Br | 5-Br | H | $CF_3$ | H | H | H |
| 65 | 4-Br | 5-Br | H | H | $CF_3$ | H | H |
| 66 | 4-Br | 5-Br | Cl | H | H | $CF_3$ | H |
| 67 | 3-Br | 5-Br | H | $CF_3$ | H | H | H |
| 68 | 3-Br | 5-Br | H | H | $CF_3$ | H | H |
| 69 | 4-Br | 5-Br | H | $CF_3$ | H | H | H |
| 70 | 3-Br | H | H | $CF_3$ | H | H | H |
| 71 | 3-Br | H | $CF_3$ | H | H | H | H |
| 72 | 3-Br | H | H | H | $CF_3$ | H | H |
| 73 | 3-Br | H | Cl | H | H | $CF_3$ | H |
| 74 | 3-Br | 6-Br | H | $CF_3$ | H | H | H |
| 75 | 3-Br | 6-Br | H | H | $CF_3$ | H | H |
| 76 | 3-Br | 6-Br | Cl | H | H | $CF_3$ | H |
| 77 | 3-Cl | 5-Br | H | $CF_3$ | H | H | H |
| 78 | 3-Br | 6-Cl | H | $CF_3$ | H | H | H |
| 79 | 3-Br | 6-F | H | $CF_3$ | H | H | H |
| 80 | 4-I | H | H | $CF_3$ | H | H | H |
| 81 | 4-I | H | H | H | $CF_3$ | H | H |
| 82 | 4-I | H | $CF_3$ | H | H | H | H |
| 83 | 4-I | H | Cl | H | H | $CF_3$ | H |
| 84 | 4-I | H | H | $C_2F_5$ | H | H | H |
| 85 | 4-I | H | H | $C_3F_7$(n) | H | H | H |
| 86 | 4-I | H | H | $C_2F_4H$ | H | H | H |
| 87 | 4-I | H | H | $CF_3$ | Cl | H | H |
| 88 | 4-I | H | Br | $CF_3$ | H | H | H |
| 89 | 4-I | H | $CF_3$ | H | H | $CF_3$ | H |
| 90 | 4-I | 5-I | H | $CF_3$ | H | H | H |
| 91 | 4-I | 5-I | H | H | $CF_3$ | H | H |
| 92 | 4-I | 5-I | Cl | H | H | $CF_3$ | H |
| 93 | 3-I | 5-I | H | $CF_3$ | H | H | H |
| 94 | 3-I | 5-I | H | H | $CF_3$ | H | H |
| 95 | 4-I | 5-I | H | $CF_3$ | H | H | H |
| 96 | 3-I | 5-I | H | $CF_3$ | H | H | H |
| 97 | 3-I | 5-I | $CF_3$ | H | H | H | H |
| 98 | 3-I | 5-I | H | H | $CF_3$ | H | H |
| 99 | 3-I | 5-I | Cl | H | H | $CF_3$ | H |
| 100 | 3-I | 6-I | H | $CF_3$ | H | H | H |
| 101 | 3-I | 6-I | H | H | $CF_3$ | H | H |
| 102 | 3-I | 6-I | Cl | H | H | $CF_3$ | H |
| 103 | 3-Cl | 5-I | H | $CF_3$ | H | H | H |
| 104 | 3-I | 6-Cl | H | $CF_3$ | H | H | H |

-continued
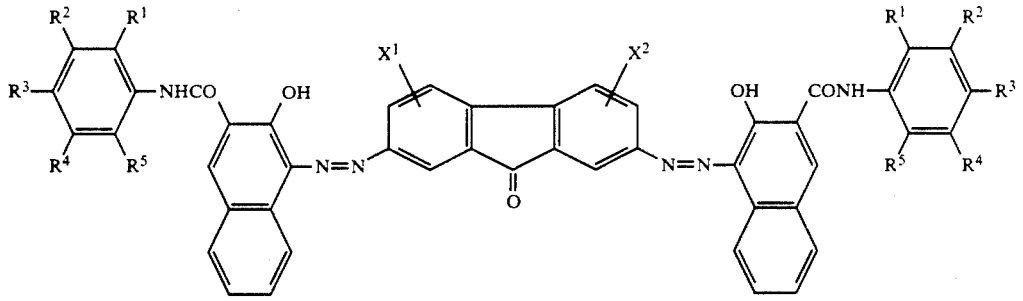
| No. | $X^1$ | $X^2$ | $R^1$ | $R^2$ | $R^3$ | $R^4$ | $R^5$ |
|---|---|---|---|---|---|---|---|
| 105 | 3-I | 6-Br | H | $CF_3$ | H | H | H |
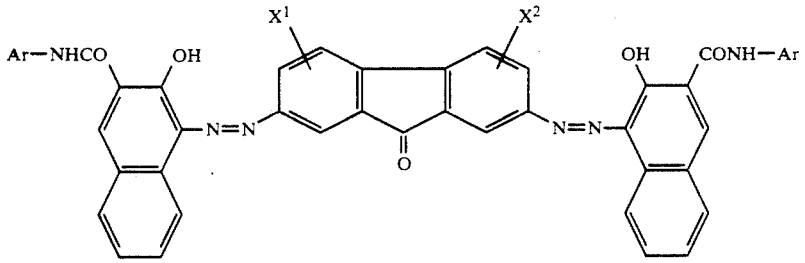
| No. | $X^1$ | $X^2$ | Ar |
|---|---|---|---|
| 106 | 4-F | H | 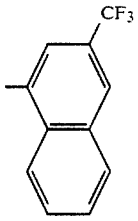 |
| 107 | 4-F | H | 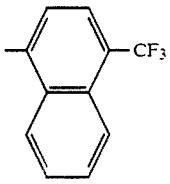 |
| 108 | 4-F | H | 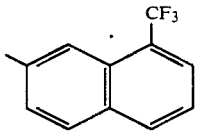 |
| 109 | 3-F | 6-F | 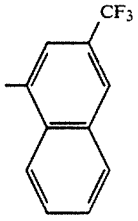 |

-continued
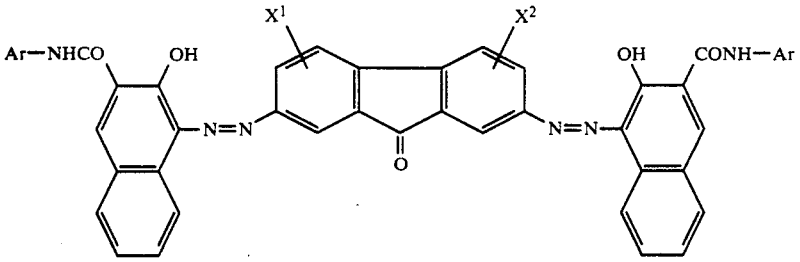
| No. | $X^1$ | $X^2$ | Ar |
|---|---|---|---|
| 110 | 4-F | H | 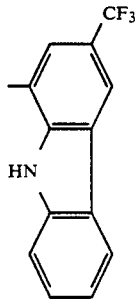 |
| 111 | 4-Cl | H | 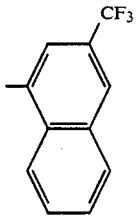 |
| 112 | 4-Cl | H | 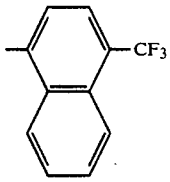 |
| 113 | 4-Cl | H | 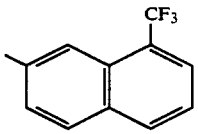 |
| 114 | 3-Cl | 6-Cl | 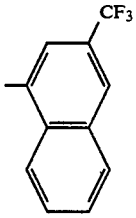 |

-continued
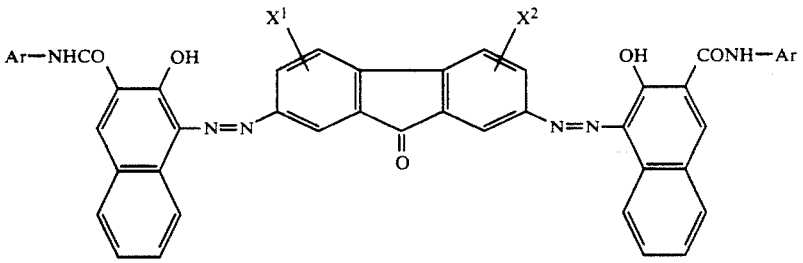
| No. | $X^1$ | $X^2$ | Ar |
|---|---|---|---|
| 115 | 4-Cl | H | 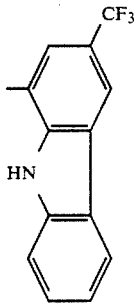 |
| 116 | 4-Br | H | 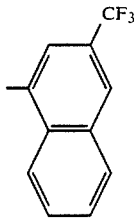 |
| 117 | 4-Br | H | 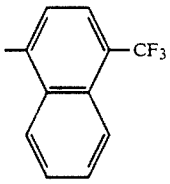 |
| 118 | 4-Br | H | 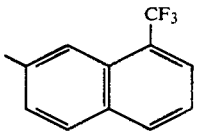 |
| 119 | 3-Br | 6-Br | 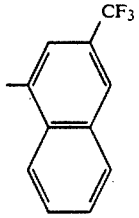 |

-continued
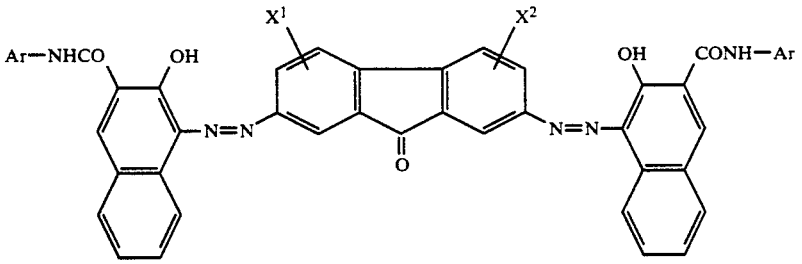
| No. | $X^1$ | $X^2$ | Ar |
|---|---|---|---|
| 120 | 4-Br | H | 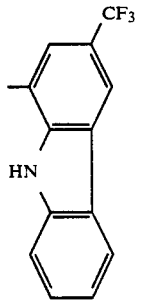 |
| 121 | 4-I | H | 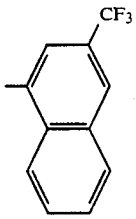 |
| 122 | 4-I | H | 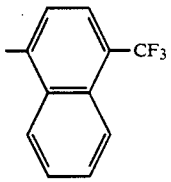 |
| 123 | 4-I | H | 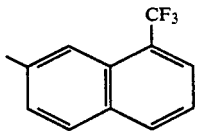 |
| 124 | 3-I | 6-I | 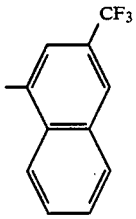 |

-continued
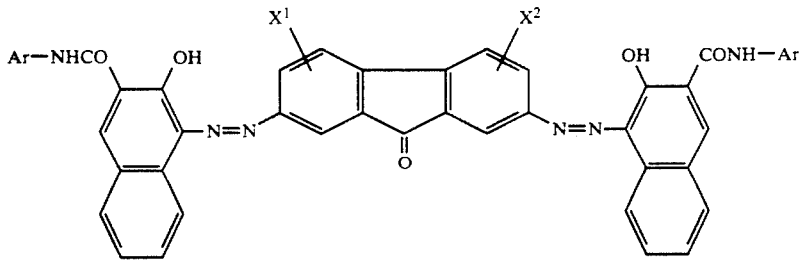
| No. | $X^1$ | $X^2$ | Ar |
|---|---|---|---|
| 125 | 4-I | H | 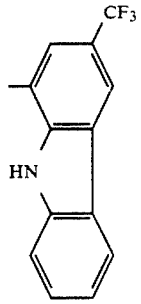 |
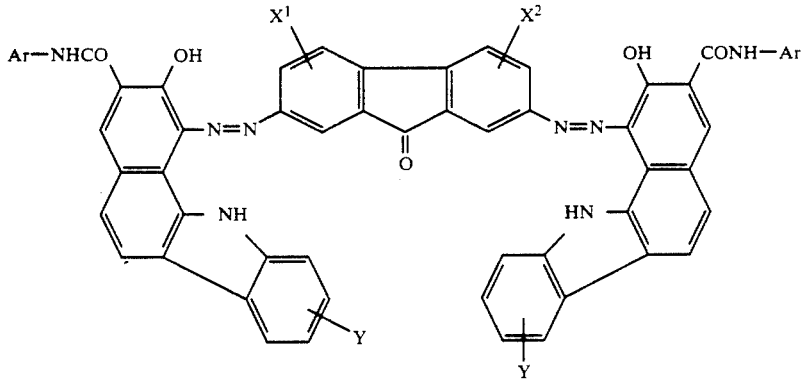
| No. | $X^1$ | $X^2$ | Y | Ar |
|---|---|---|---|---|
| 126 | 4-F | H | H | 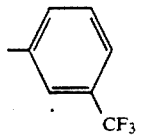 |
| 127 | 4-F | H | H | 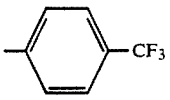 |
| 128 | 4-F | H | H | 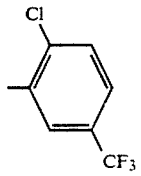 |

-continued
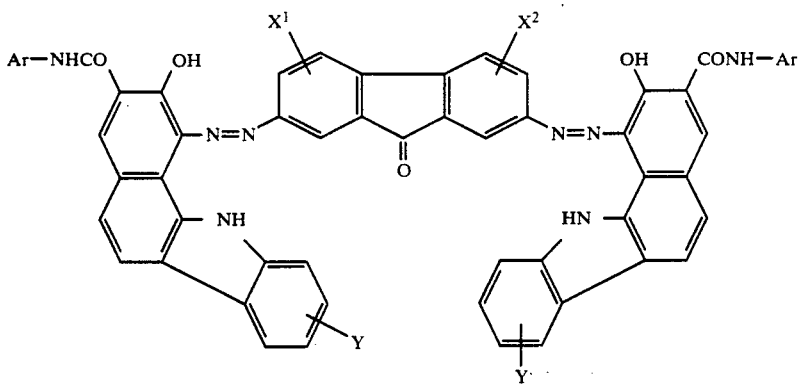
| No. | $X^1$ | $X^2$ | Y | Ar |
|---|---|---|---|---|
| 129 | 3-F | H | Cl | 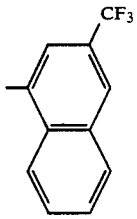 |
| 130 | 4-Cl | H | H | 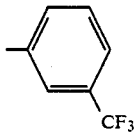 |
| 131 | 4-Cl | H | H | 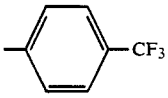 |
| 132 | 4-Cl | H | H | 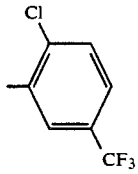 |
| 133 | 3-Cl | H | Cl | 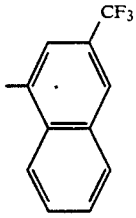 |
| 134 | 4-Br | H | H | 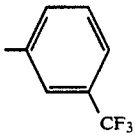 |
| 135 | 4-Br | H | H | 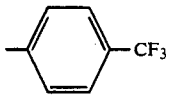 |

-continued

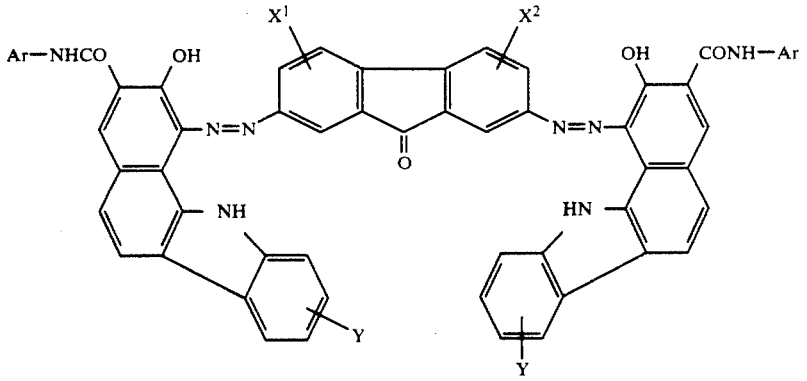

| No. | $X^1$ | $X^2$ | Y | Ar |
|---|---|---|---|---|
| 136 | 4-Br | H | H | 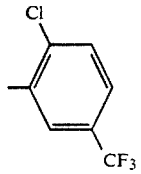 |
| 137 | 3-Br | H | Cl | 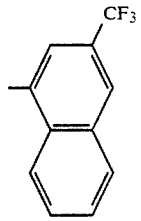 |
| 138 | 4-I | H | H | 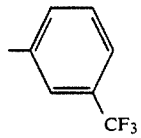 |
| 139 | 4-I | H | H | 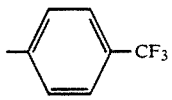 |
| 140 | 4-I | H | H | 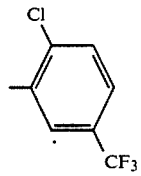 |
| 141 | 3-I | H | Cl | 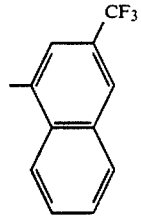 |

The bisazo compounds of the general formula (I) can be easily synthesized by known methods as described below. Synthesis 1 (synthesis of compound No. 54):

2,7-Diamino-4-bromo-9-fluorenone (2.89 g, 0.01 mol) is dispersed in 10 ml of HCl and 20 ml of water, and a solution having 1.40 g (0.02 mol) of sodium sulfite dissolved in 5 ml of water is added dropwise to the dispersion as it is held at 5° C. or below. Following stirring for an additional hour at the same temperature, the insoluble matter is filtered off and a solution having 4.6 g of ammonium hexafluorophosphate dissolved in 50 ml of water is added to the filtrate. The crystallizing tetrazonium salt is recovered by filtration and dissolved in 100 ml of N,N-dimethylformamide (DMF). To the solution held at 5° C. or below, a solution having 6.62 g (0.02 mol) of 2-hydroxy-3-naphthoic acid-3'-trifuluoromethyl anilide dissolved in 200 ml of DMF is added dropwise.

A solution having 6 g (0.04 mol) of triethanolamine dissolved in 30 ml of DMF is added dropwise to the mixture as it is continuously kept at 5° C. or below, and thereafter, the mixture is stirred for 1 h at 5° C. or below and for 4 h at room temperature. After the reaction, the resulting crystal is recovered by filtration, washed first with DMF and then with water, and dried to obtain the end product in an amount of 8.71 g.

Elemental analysis: cal'd ,C=60.5%, H=2.77%, N=8.63%, found, C=60.1%, H=2.95%, N=8.72%.

Synthesis 2 (synthesis of compound No. 134):

2,7-Diamino-4-bromo-9-fluorenone (2.89 g, 0.01 mol) is dispersed in 10 ml of HCl and 20 ml of water, and a solution having 1.40 g (0.02 mol) of sodium sulfite dissolved in 5 ml of water is added dropwise to the dispersion as it is held at 5° C. or below. Following stirring for an additional hour at the same temperature, the insoluble matter is filtered off and a solution having 4.6 g of ammonium hexafluorophosphate dissolved in 50 ml of water is added to the filtrate. The crystallizing tetrazonium salt is recovered by filtration and dissolved in 100 ml of N,N-dimethylformamide (DMF). To the solution held at 5° C. for below, a solution having 8.40 g (0.02 mol) of 2-hydroxy-3-(3'-trifluoromethylphenylcarbamoyl)benzo[a]carbazole dissolved in 200 ml of DMF is added dropwise.

A solution having 6 g (0.04 mol) of triethanolamine dissolved in 30 ml of DMF is added dropwise to the mixture as it is held at 5° C. or below, and thereafter, the mixture is stirred for 1 h at 5° C. or below and for 4 h at room temperature. After the reaction, the resulting crystal is recovered by filtration, washed first with DMF and then with water, and dried to obtain the end product in an amount of 5.2 g.

Elemental analysis: cal'd,C=63.6%, H=2.87%, N=9.73%., found, C=63.4%,H=2.97%,N=10.01%.

Other compounds of the formula (I) can by synthesized by similar procedures to Synthesis 1, in which diazonium salts are prepared from corresponding amino compounds and are then reacted with 2-hydroxy-3-naphthoic acid-substituted anilide or 2-hydroxy-3-(substituted phenylcarbamoyl)benzo[a]-substituted or unsubstituted carbazole.

The polycyclic quinone compound to be used in the present invention is at least one member of the group consisting of anthanthrone pigments represented by the following general formula (A), dibenzpyrenequinone pigments represented by the general formula (B) and pyranthrone pigments represented by the general formula (C):

[A]

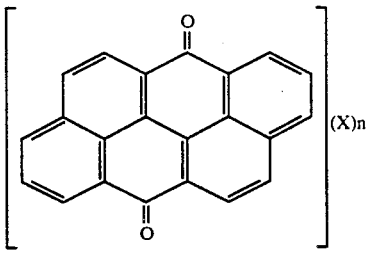

[B]

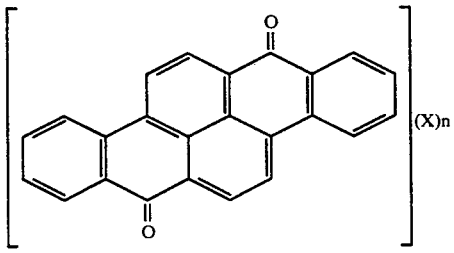

[C]

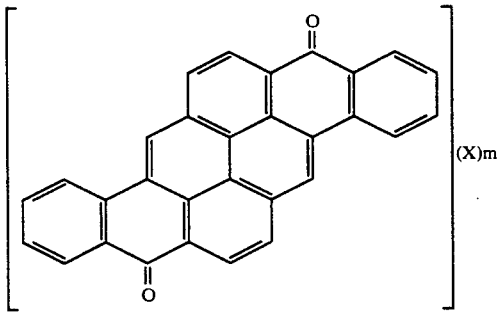

where X is a halogen atom, a nitro group, a cyano group, an acyl group or a carboxyl group; n is an integer of 0–4; and m is an integer of 0–6.

Specific examples of the anthanthrone pigments represented by the general formula (A) are listed below.

[A1]

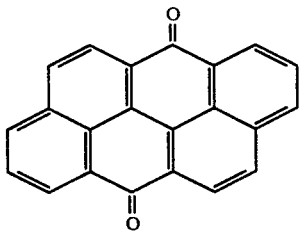

[A2]

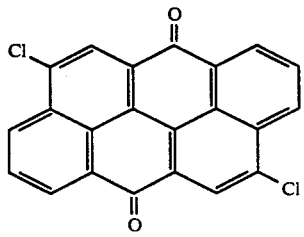

-continued
[A3]
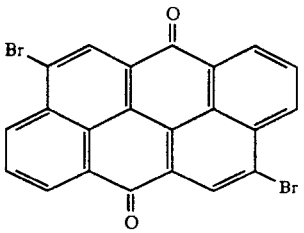
[A4]
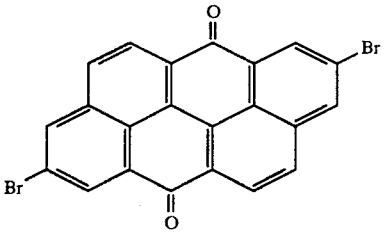
[A5]
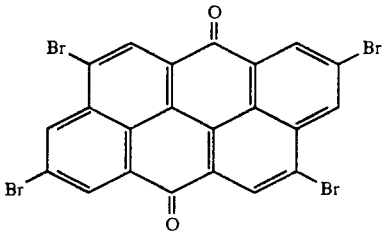
[A6]
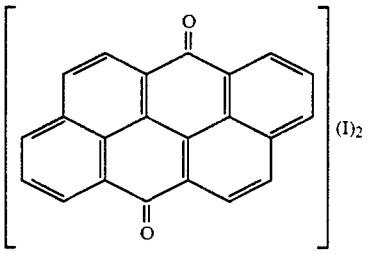
[A7]
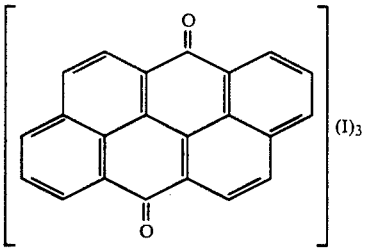
[A8]
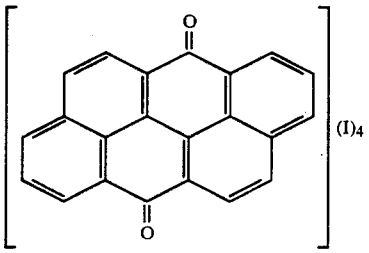
-continued
[A9]
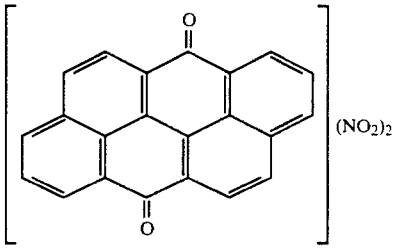
[A10]
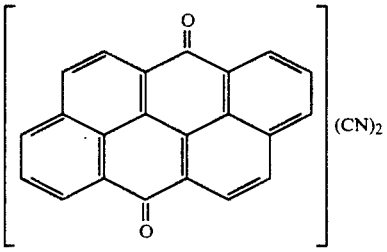
[A11]
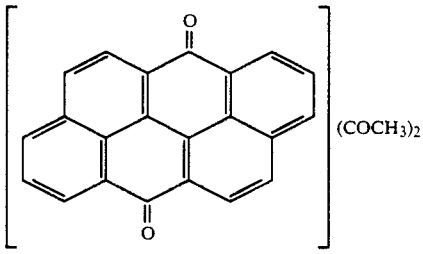
Specific examples of the dibenzypyrenequinone pigments represented by the general formula (B) are listed below.
[B1]
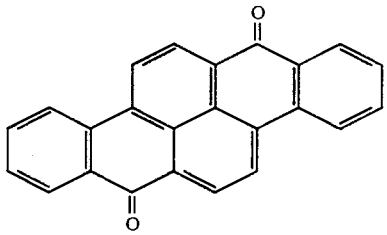
[B2]
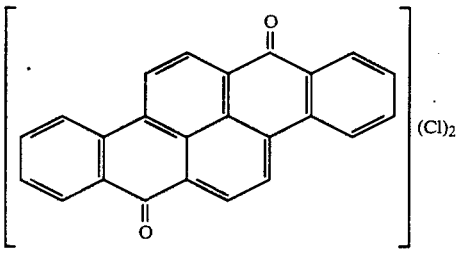
[B3]
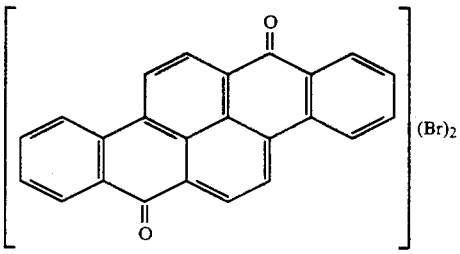

-continued
[B4]
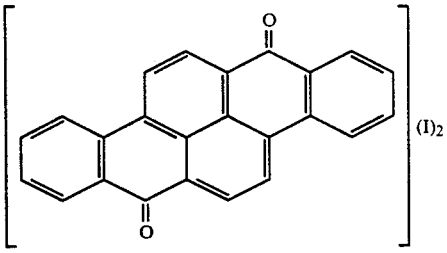
[B5]
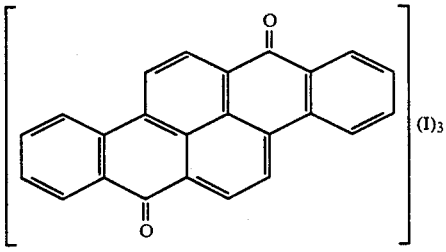
[B6]
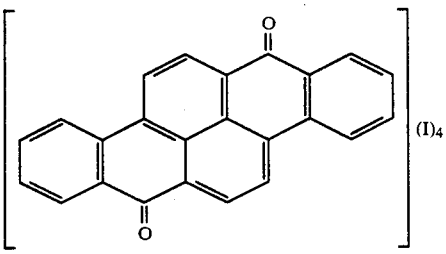
[B7]
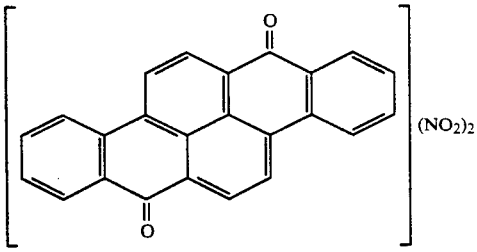
[B8]
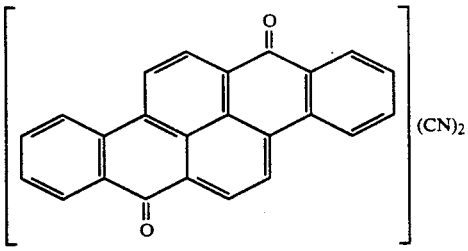
[B9]
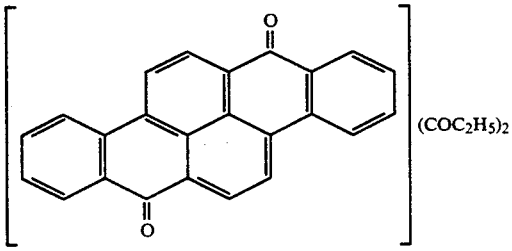
Specific examples of the pyranthrone pigments represented by the general formula (C) are listed below.
[C1]
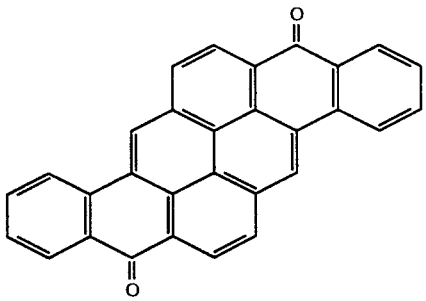
[C2]
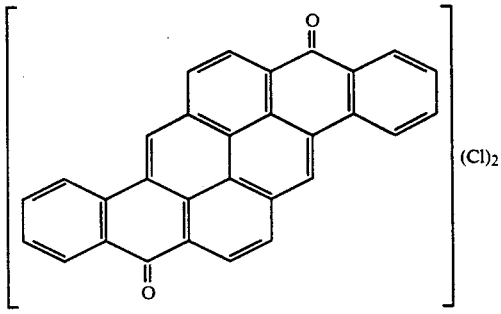
[C3]
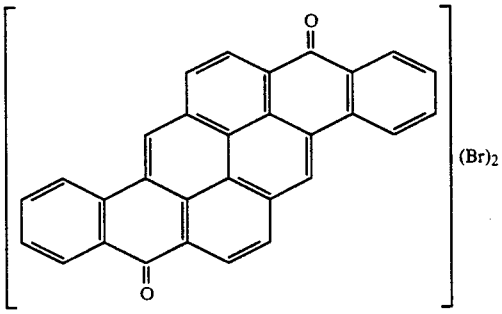
[C4]
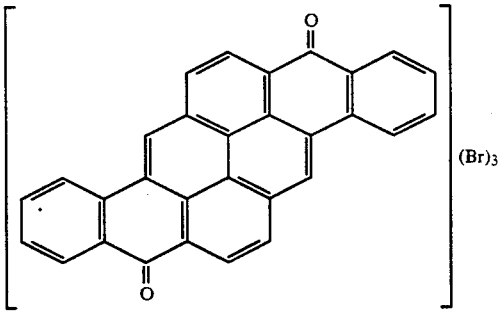
[C5]
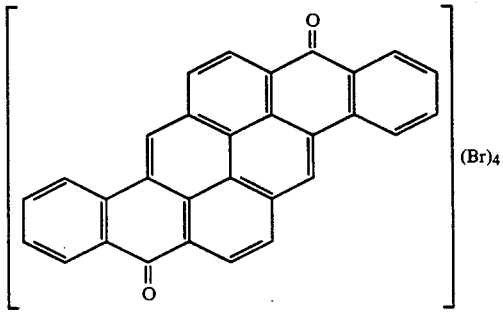

-continued

[C6]

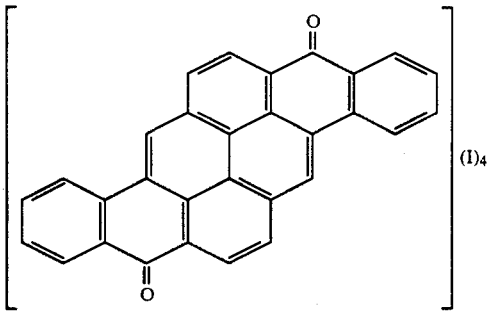

[C7]

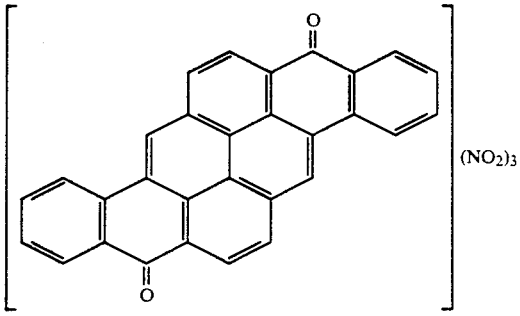

[C8]

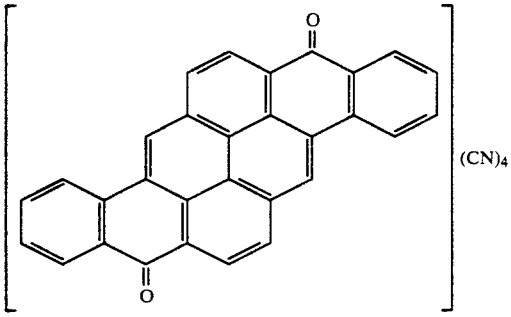

-continued

[C9]

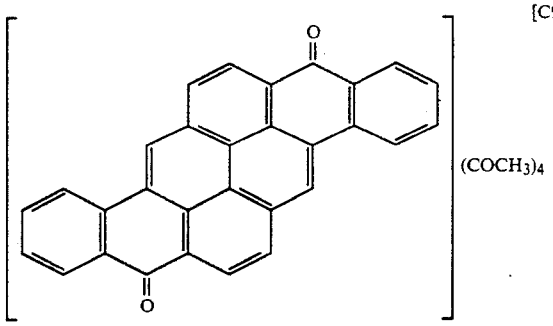

The polycyclic quinone compounds listed above can be synthesized by known methods or they are available as commercial products.

The photoreceptor of the present invention contains a carrier transport material of the general formula (II) in addition to the carrier generation materials described above. In the compound represented by the general formula (II) (which is hereinafter sometimes referred to as the stilbene compound of the present invention), the alkyl group represented by each of $R_2$, $R_3$, $R_4$ and $R_5$ may be exemplified by methyl, ethyl, propyl, butyl, pentyl and hexyl, and the aryl group represented by each of $R^1$, $R_2$, $R_3$, $R_4$ and $R_5$ may be exemplified by carbocyclic or heterocyclic mononuclear or polynuclear aromatic residues including phenyl, naphthyl, thienyl, pyridyl, carbazolyl, etc. Examples of the arylene group represented by $Ar_1$ include such carbo-cyclic or heterocyclic mononuclear or polynuclear aromatic residues. In the stilbene compound of the present invention, the substituent on the alkyl, aryl, arylene or styryl group may be exemplified by an alkyl group, an alkoxy group, an aryl group, an aryloxy group, an amino group, a hydroxy group, a halogen atom, etc.

In the present invention, it is preferred that all of $R_1$, $R_2$, $R_4$ and $R_5$ are an aryl group.

The stilbene compounds of the general formula (II) are illustrated by, but are by no means limited to, the following examples.

Illustrative compounds

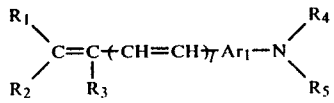
| Compound No. | $R_1$ | $R_2$ | $R_3$ | l | $Ar_1$ | $R_4$ | $R_5$ |
|---|---|---|---|---|---|---|---|
| 1 | 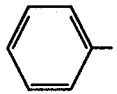 | H | H | 1 | 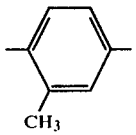 | 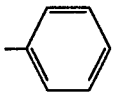 | 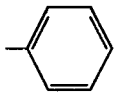 |
| 2 | 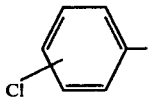 | H | H | 1 | 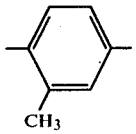 | 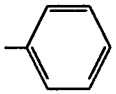 | 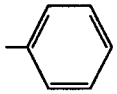 |
| 3 | 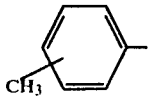 | H | H | 1 | 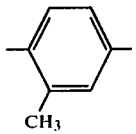 | 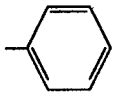 | 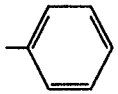 |
| 4 | 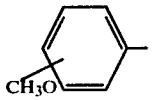 | H | H | 1 | 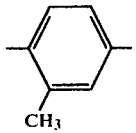 | 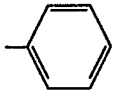 | 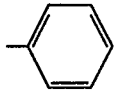 |
| 5 | 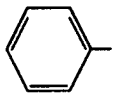 | $CH_3$ | H | 0 | 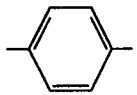 | $CH_3$ | $CH_3$ |
| 6 | 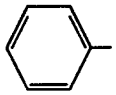 | $CH_3$ | H | 0 | 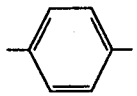 | $CH_3$ | 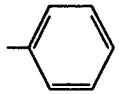 |

-continued
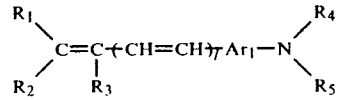
| Compound No. | $R_1$ | $R_2$ | $R_3$ | l | $Ar_1$ | $R_4$ | $R_5$ |
|---|---|---|---|---|---|---|---|
| 7 | 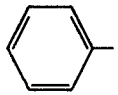 | $CH_3$ | H | 0 | 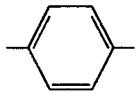 | 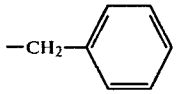 | 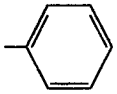 |
| 8 | 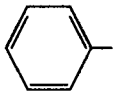 | $CH_3$ | H | 0 | 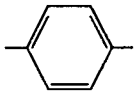 | 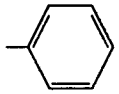 | 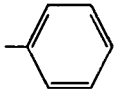 |
| 9 | 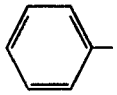 | $CH_3$ | H | 0 | 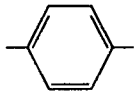 | 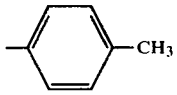 | 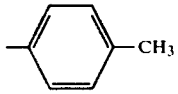 |
| 10 | 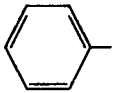 | $CH_3$ | H | 0 | 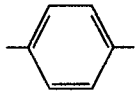 | 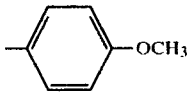 | 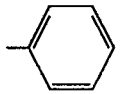 |
| 11 | 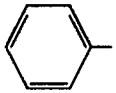 | $CH_3$ | H | 0 | 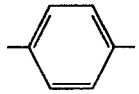 | 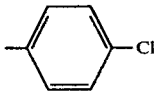 | 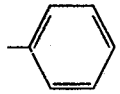 |
| 12 | 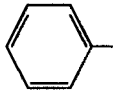 | $CH_3$ | H | 0 | 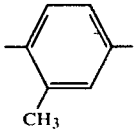 | 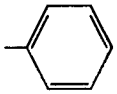 | 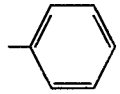 |
| 13 | 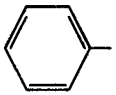 | $CH_3$ | 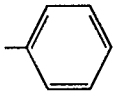 | 0 | 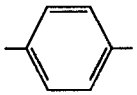 | 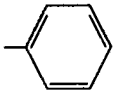 | 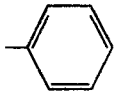 |

-continued
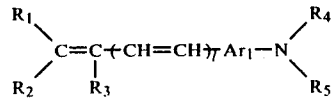
| Compound No. | $R_1$ | $R_2$ | $R_3$ | l | $Ar_1$ | $R_4$ | $R_5$ |
|---|---|---|---|---|---|---|---|
| 14 | 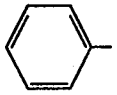 | $CH_3$ | 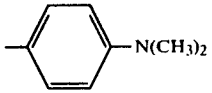 | 0 | 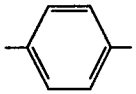 | $CH_3$ | $CH_3$ |
| 15 | 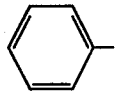 | $CH_3$ | 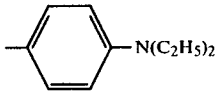 | 0 | 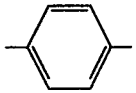 | $C_2H_5$ | $C_2H_5$ |
| 16 | 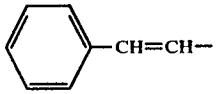 | $CH_3$ | H | 0 | 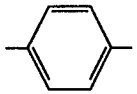 | 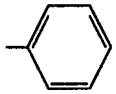 | 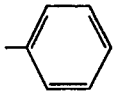 |
| 17 | 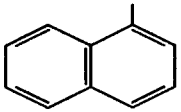 | $CH_3$ | H | 0 | 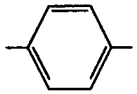 | 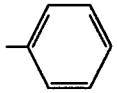 | 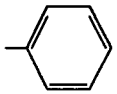 |
| 18 | 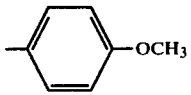 | $CH_3$ | H | 0 | 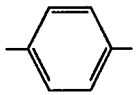 | 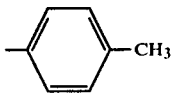 | 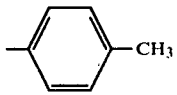 |
| 19 | 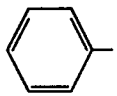 | $C_2H_5$ | H | 0 | 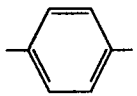 | 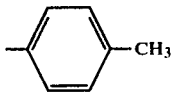 | 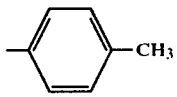 |
| 20 | 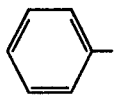 | $C_3H_7(n)$ | H | 0 | 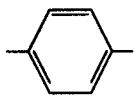 | 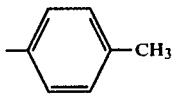 | 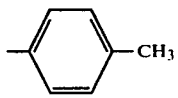 |

-continued
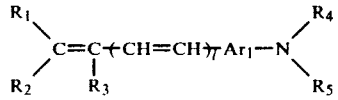
| Compound No. | $R_1$ | $R_2$ | $R_3$ | l | $Ar_1$ | $R_4$ | $R_5$ |
|---|---|---|---|---|---|---|---|
| 21 | 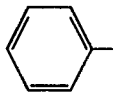 | $C_4H_9(n)$ | H | 0 | 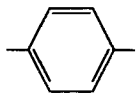 | 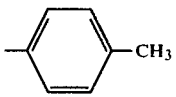 $CH_3$ | 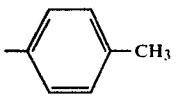 $CH_3$ |
| 22 | 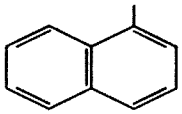 | $C_2H_5$ | H | 0 | 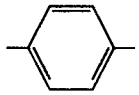 | 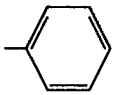 | 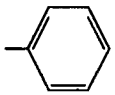 |
| 23 | 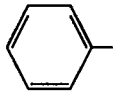 | $-CH_2-$ 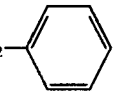 | H | 0 | 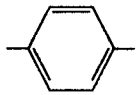 | 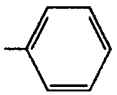 | 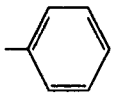 |
| 24 | 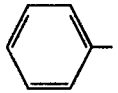 | $-CH_2-$ 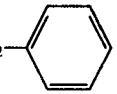 | H | 0 | 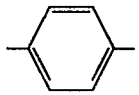 | $C_2H_5$ | $C_2H_5$ |
| 25 | 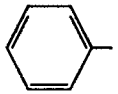 | $-CH_2-$ 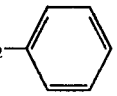 | H | 0 | 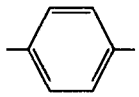 | $C_2H_5$ | 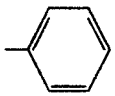 |
| 26 | 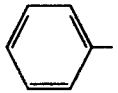 | $-CH_2-$ 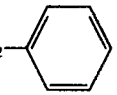 | H | 0 | 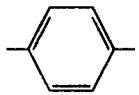 | 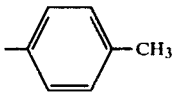 $CH_3$ | 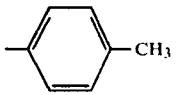 $CH_3$ |
| 27 | 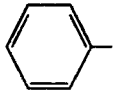 | $-CH_2-$ 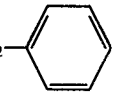 | H | 0 | 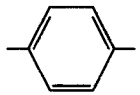 | $-CH_2-$ 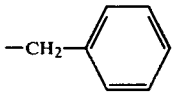 | 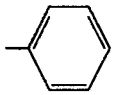 |

-continued
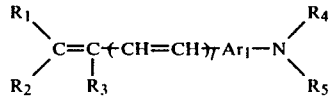
| Compound No. | $R_1$ | $R_2$ | $R_3$ | l | $Ar_1$ | $R_4$ | $R_5$ |
|---|---|---|---|---|---|---|---|
| 28 | 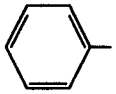 | 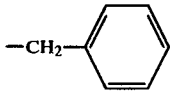 | H | 0 | 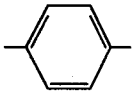 | 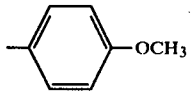 | 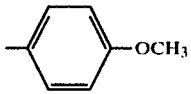 |
| 29 | 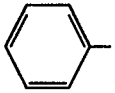 | 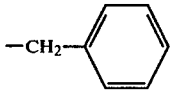 | H | 0 | 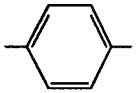 | 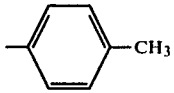 | 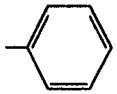 |
| 30 | 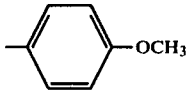 | 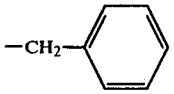 | H | 0 | 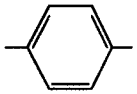 | 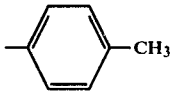 | 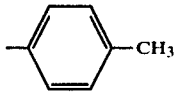 |
| 31 | 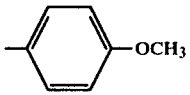 | 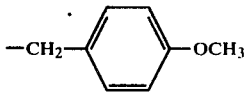 | H | 0 | 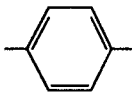 | 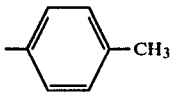 | 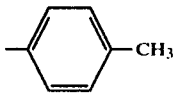 |
| 32 | 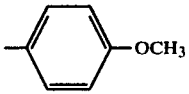 | 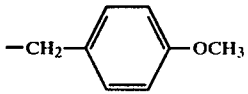 | H | 0 | 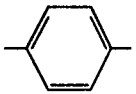 | 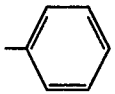 | 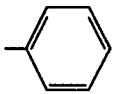 |
| 33 | 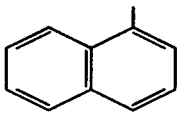 | 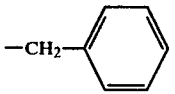 | H | 0 | 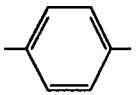 | 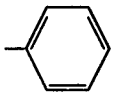 | 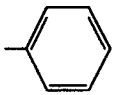 |
| 34 | 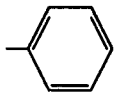 | 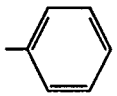 | H | 0 | 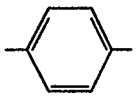 | 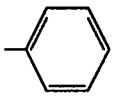 | 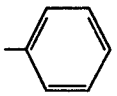 |

-continued
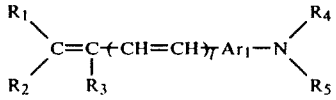
| Compound No. | $R_1$ | $R_2$ | $R_3$ | l | $Ar_1$ | $R_4$ | $R_5$ |
|---|---|---|---|---|---|---|---|
| 35 | 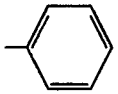 | 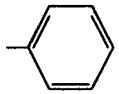 | H | 0 | 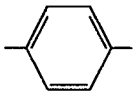 | 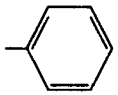 | 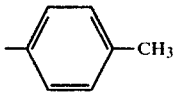 $CH_3$ |
| 36 | 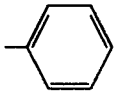 | 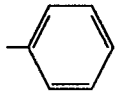 | H | 0 | 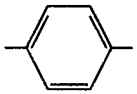 | 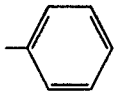 | 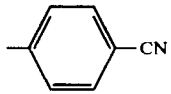 CN |
| 37 | 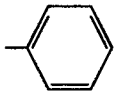 | 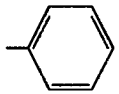 | H | 0 | 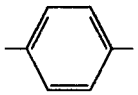 | 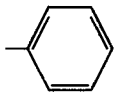 | 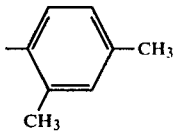 $CH_3$ $CH_3$ |
| 38 | 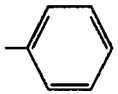 | 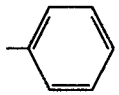 | H | 0 | 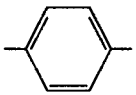 | 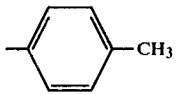 $CH_3$ | 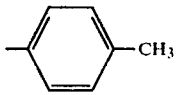 $CH_3$ |
| 39 | 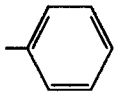 | 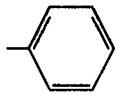 | H | 0 | 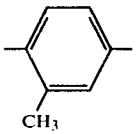 $CH_3$ | 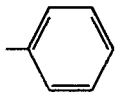 | 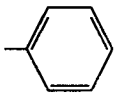 |
| 40 | 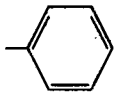 | 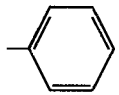 | H | 0 | 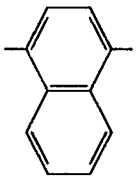 | 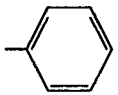 | 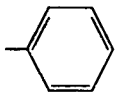 |

-continued
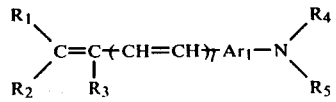
| Compound No. | $R_1$ | $R_2$ | $R_3$ | l | $Ar_1$ | $R_4$ | $R_5$ |
|---|---|---|---|---|---|---|---|
| 41 | 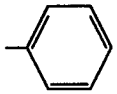 | 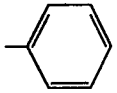 | H | 0 | 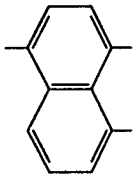 | 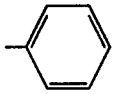 | 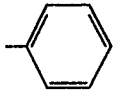 |
| 42 | 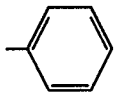 | 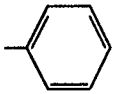 | H | 0 | 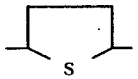 | 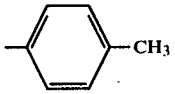 | 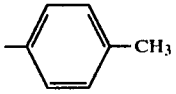 |
| 43 | 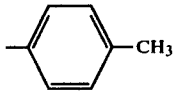 | 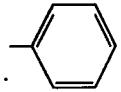 | H | 0 | 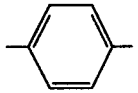 | 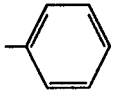 | 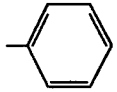 |
| 44 | 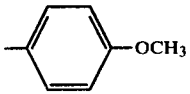 | 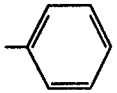 | H | 0 | 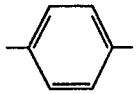 | 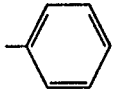 | 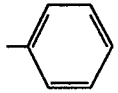 |
| 45 | 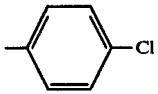 | 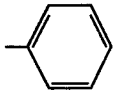 | H | 0 | 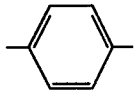 | 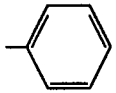 | 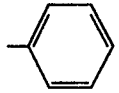 |
| 46 | 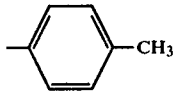 | 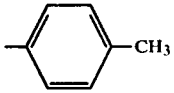 | H | 0 | 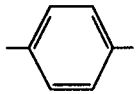 | 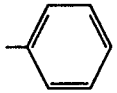 | 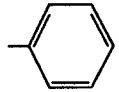 |
| 47 | 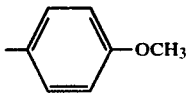 | 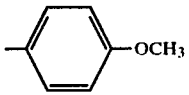 | H | 0 | 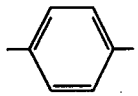 | 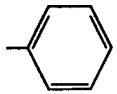 | 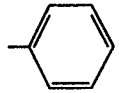 |

-continued
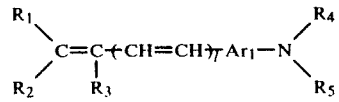
| Compound No. | $R_1$ | $R_2$ | $R_3$ | l | $Ar_1$ | $R_4$ | $R_5$ |
|---|---|---|---|---|---|---|---|
| 48 | 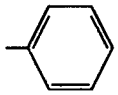 | 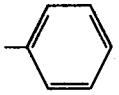 | H | 0 | 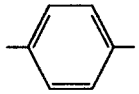 | 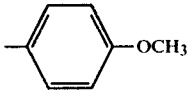 | 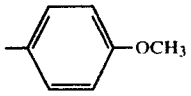 |
| 49 | 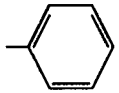 | 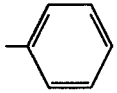 | H | 0 | 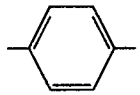 | 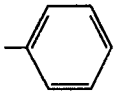 | 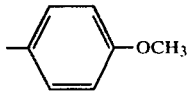 |
| 50 | 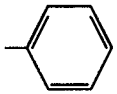 | 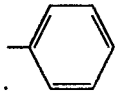 | H | 0 | 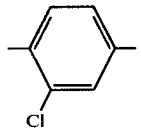 | $CH_3$ | $CH_3$ |
| 51 | 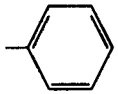 | 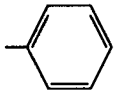 | H | 0 | 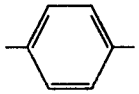 | $C_2H_5$ | $C_2H_5$ |
| 52 | 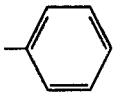 | 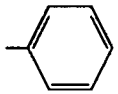 | H | 0 | 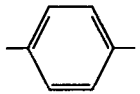 | 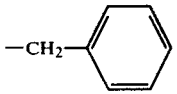 | 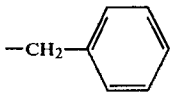 |
| 53 | 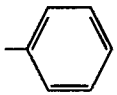 | 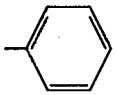 | H | 0 | 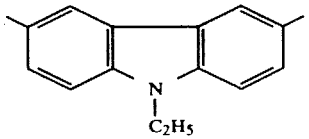 | 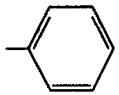 | 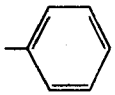 |

-continued
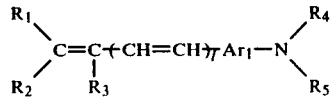
| Compound No. | $R_1$ | $R_2$ | $R_3$ | l | $Ar_1$ | $R_4$ | $R_5$ |
|---|---|---|---|---|---|---|---|
| 54 | 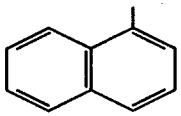 | 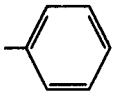 | H | 0 | 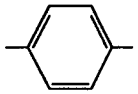 | 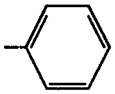 | 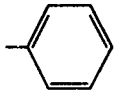 |
| 55 | 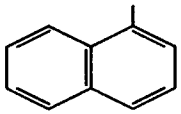 | 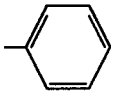 | H | 0 | 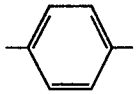 | 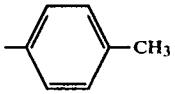 | 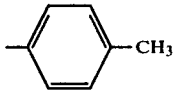 |
| 56 | 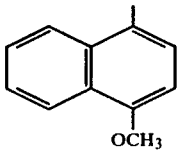 | 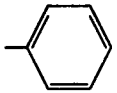 | H | 0 | 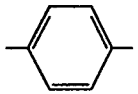 | 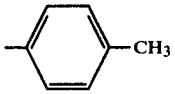 | 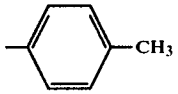 |
| 57 | 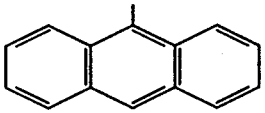 | 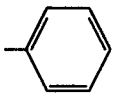 | H | 0 | 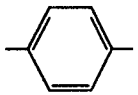 | 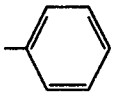 | 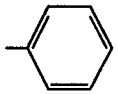 |
| 58 | 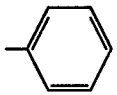 | $CH_3$ | H | 0 | 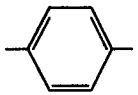 | 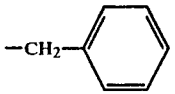 | 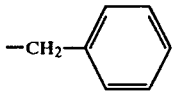 |
| 59 | 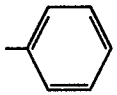 | 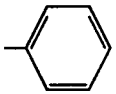 | H | 0 | 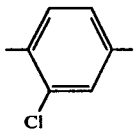 | 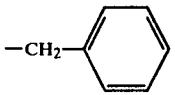 | 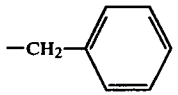 |

-continued
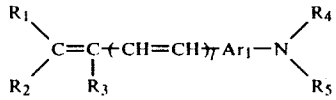
| Compound No. | $R_1$ | $R_2$ | $R_3$ | l | $Ar_1$ | $R_4$ | $R_5$ |
|---|---|---|---|---|---|---|---|
| 60 | 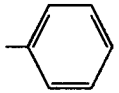 | 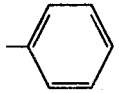 | H | 0 | 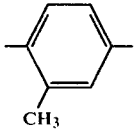 | 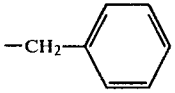 | 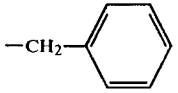 |
| 61 | 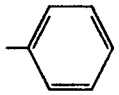 | 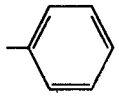 | H | 0 | 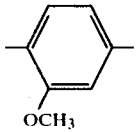 | 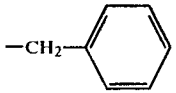 | 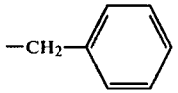 |
| 62 | 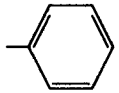 | 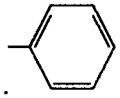 | H | 0 | 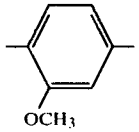 | 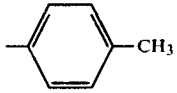 | 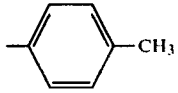 |
| 63 | 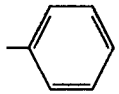 | 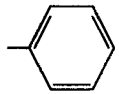 | H | 0 | 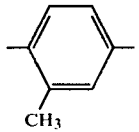 | 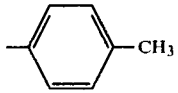 | 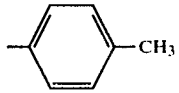 |
| 64 | 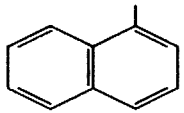 | 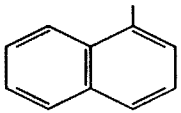 | H | 0 | 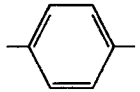 | 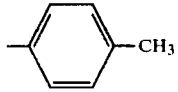 | 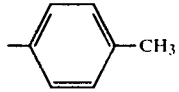 |
| 65 | 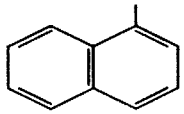 | 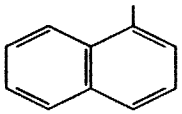 | H | 0 | 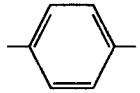 | 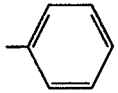 | 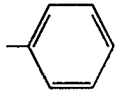 |

-continued
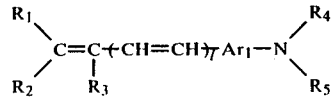
| Compound No. | $R_1$ | $R_2$ | $R_3$ | l | $Ar_1$ | $R_4$ | $R_5$ |
|---|---|---|---|---|---|---|---|
| 66 | 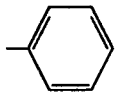 | 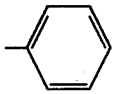 | 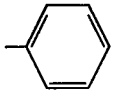 | 0 | 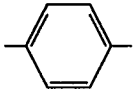 | 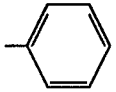 | 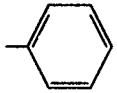 |
| 67 | 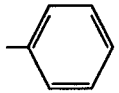 | 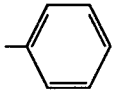 | 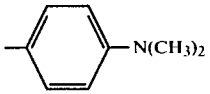 $N(CH_3)_2$ | 0 | 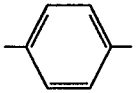 | $CH_3$ | $CH_3$ |
| 68 | 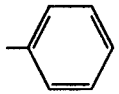 | 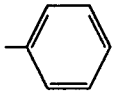 | $CH_3$ | 0 | 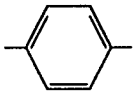 | 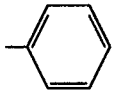 | 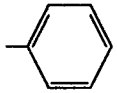 |
| 69 | 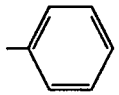 | 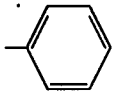 | 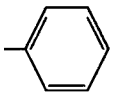 | 0 | 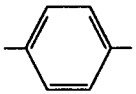 | $C_2H_5$ | $C_2H_5$ |
| 70 | 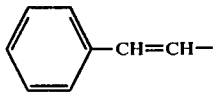 $CH=CH-$ | 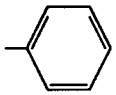 | H | 0 | 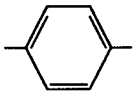 | 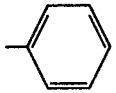 | 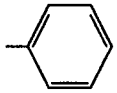 |
| 71 | 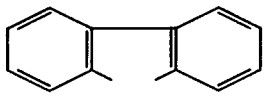 | | H | 0 | 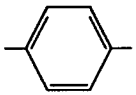 | 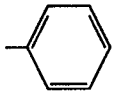 | 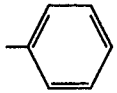 |
| 72 | 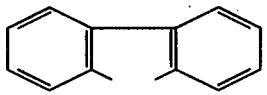 | | H | 0 | 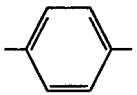 | 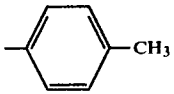 $CH_3$ | 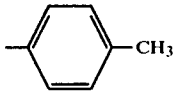 $CH_3$ |

-continued
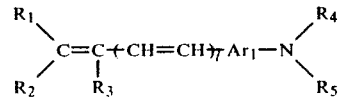
| Compound No. | $R_1$ | $R_2$ | $R_3$ | l | $Ar_1$ | $R_4$ | $R_5$ |
|---|---|---|---|---|---|---|---|
| 73 | 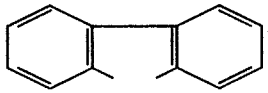 | | H | 0 | 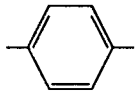 | 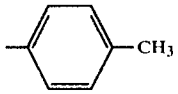 $CH_3$ | 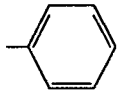 |
| 74 | 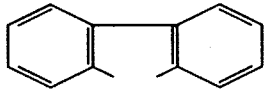 | | H | 0 | 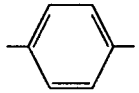 | 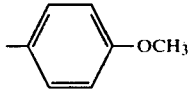 $OCH_3$ | 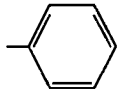 |
| 75 | 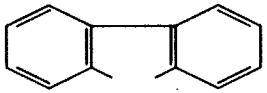 | | H | 0 | 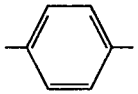 | $C_2H_5$ | 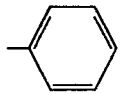 |
| 76 | 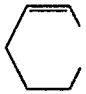 | | H | 0 | 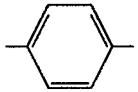 | 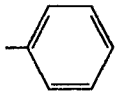 | 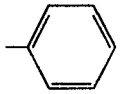 |
| 77 | 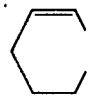 | | H | 0 | 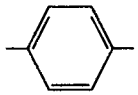 | 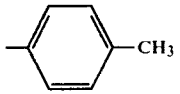 $CH_3$ | 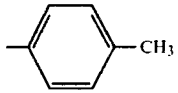 $CH_3$ |
| 78 | 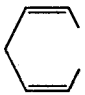 | | H | 0 | 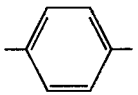 | 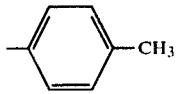 $CH_3$ | 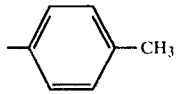 $CH_3$ |
| 79 | 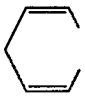 | | H | 0 | 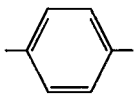 | 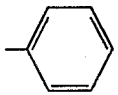 | 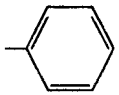 |

-continued
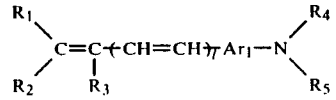
| Compound No. | $R_1$ | $R_2$ | $R_3$ | l | $Ar_1$ | $R_4$ | $R_5$ |
|---|---|---|---|---|---|---|---|
| 80 | 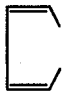 | | H | 0 | 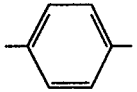 | 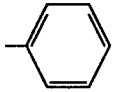 | 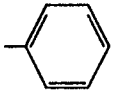 |
| 81 | 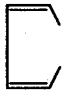 | | H | 0 | 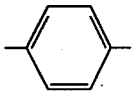 | 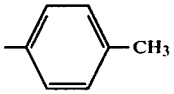 | 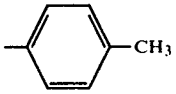 |
| 82 | 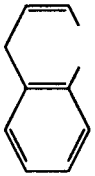 | | H | 0 | 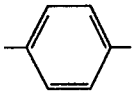 | 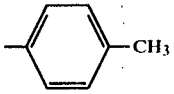 | 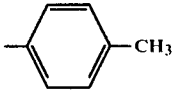 |
| 83 | 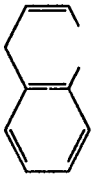 | | H | 0 | 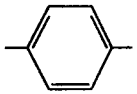 | 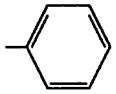 | 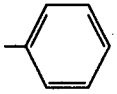 |
| 84 | 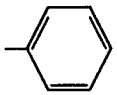 | $CH_3$ | H | 1 | 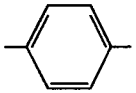 | 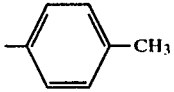 | 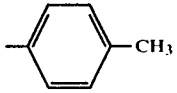 |
| 85 | 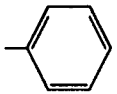 | $C_2H_5$ | H | 1 | 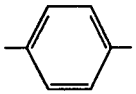 | 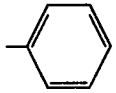 | 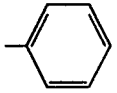 |

-continued
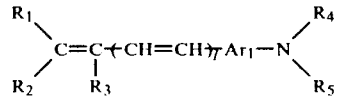
| Compound No. | $R_1$ | $R_2$ | $R_3$ | l | $Ar_1$ | $R_4$ | $R_5$ |
|---|---|---|---|---|---|---|---|
| 86 | 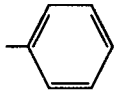 | $C_2H_5$ | H | 1 | 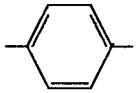 | 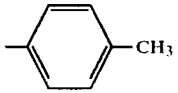 $CH_3$ | 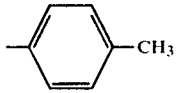 $CH_3$ |
| 87 | 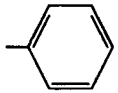 | $-CH_2-$ 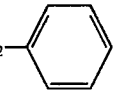 | H | 1 | 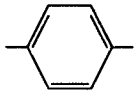 | 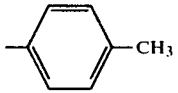 $CH_3$ | 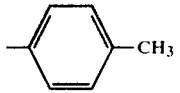 $CH_3$ |
| 88 | 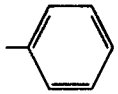 | 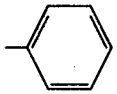 | H | 1 | 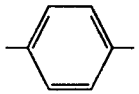 | 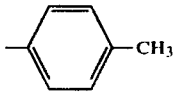 $CH_3$ | 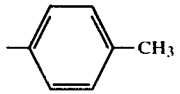 $CH_3$ |
| 89 | 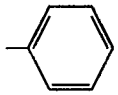 | 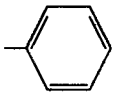 | H | 1 | 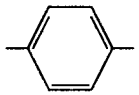 | 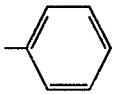 | 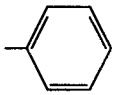 |
| 90 | 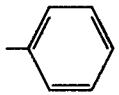 | $CH_3$ | H | 1 | 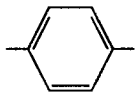 | $CH_3$ | $CH_3$ |
| 91 | 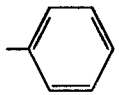 | 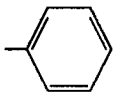 | H | 1 | 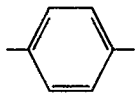 | $CH_3$ | $CH_3$ |
| 92 | 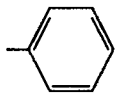 | 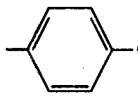 $CH_3$ | H | 0 | 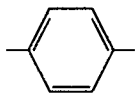 | 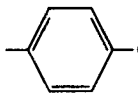 $OCH_3$ | 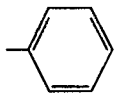 |
| 93 | 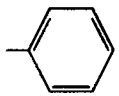 | 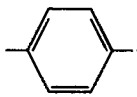 $CH_3$ | H | 0 | 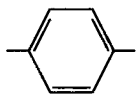 | 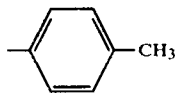 $CH_3$ | 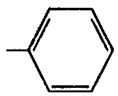 |

The stilbene compounds of the present invention listed above can be easily synthesized by one skilled in the art by referring to the methods described in prior art documents including Unexamined Published Japanese Patent Application Nos. 94462/1985 and 98437/1985.

Figure 4:
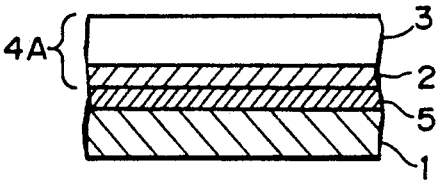
Figure 5:
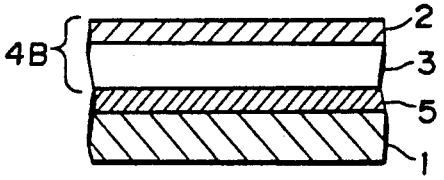
Figure 6:
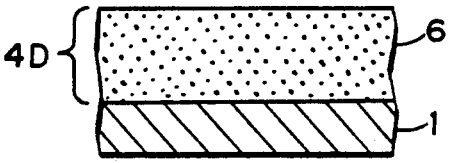
Figure 7:
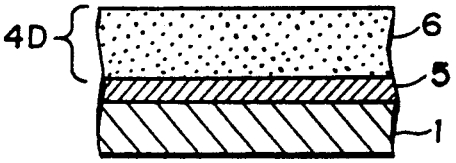

Various structural forms are known with respect to electrophotographic photoreceptors and any of them can be adopted by the photoreceptor of the present invention. Common structural forms are shown in FIGS. 2–7. The photoreceptor shown in FIG. 2 comprises an electroconductive base 1 which has formed thereon a light-sensitive layer 4A comprising a carrier generation layer 2 that contains both the polycyclic quinone compound (A), (B) or (C) and the compound (I) and, optionally, a carrier transport material, which layer 2 is overlaid with a carrier transport layer 3 that contains the carrier transport material (II) as the chief component. The order of superposition of the carrier generation layer 2 and the carrier transport layer 3 may be reversed as shown by 4B in FIG. 3. As shown in FIGS. 4 and 5, an intermediate layer 5 such as an adhesive layer or a barrier layer may be disposed between the light-sensitive layer 4A or 4B and the conductive base 1. By adopting a dual structure as in the light-sensitive layer 4A or 4B, a photoreceptor having most desirable electrophotographic characteristics can be obtained. Other modifications of the photoreceptor of the present invention are shown in FIGS. 6 and 7. In the case shown in FIG. 6, a light-sensitive layer 4D having the polycyclic quinone compound (A), (B) or (C) and the compound (I) dispersed in a layer 6 that contains the carrier transport material (II) is formed directly on the conductive base 1 as shown in FIG. 6 or, alternatively, an intermediate layer 5 may be provided between the lightsensitive layer 4D and the conductive base 1 as shown in FIG. 7. If necessary, a protective layer may be formed as the outermost layer.

The "light-sensitive layer that contains as carrier generation materials a polycyclic quinone compound represented by the general formula (A), (B) or (C) and a compound represented by the following general formula (I) and that also contains a compound represented by the following general formula (II) as a carrier transport material" may be a single layer in which the carrier generation materials are dispersed as an admixture with the carrier transport material. But more preferably, said light-sensitive layer is a unitary assembly in which a carrier generation layer containing the polycyclic quinone compound and the bisazo compound as carrier generation materials is superposed on or overlaid with a carrier transport layer containing the stilbene compound of the present invention as a carrier transport material.

The carrier generation layer 2 or the light-sensitive layer 4D can be formed by the following methods on the conductive base 1 or the carrier transport layer 3 either directly or via an optional intermediate layer 5 such as an adhesive or barrier layer:

M-1) the polycyclic quinone compound and the azo compound of the general formula (I) are dissolved in a suitable solvent either as an admixture or separately from each other, and after adding a binder resin as required, the resulting solution is coated; or M-2) the polycyclic quinone compound and the azo compound of the formula (I) are dispersed, either as an admixture or separately from each other, in a suitable dispersion medium with a ball mill, a homomixer, etc. to produce fine particles (preferably not larger than 5 μm, more preferably L not larger than 1 μm), and after adding a binder resin as required, the resulting dispersion is coated.

Exemplary solvents or dispersion media that can be used to form the carrier generation layer include: n-butylamine, diethylamine, ethylenediamine, isopropanolamine, triethanolamine, triethylenediamine, N,N-dimethylformamide, acetone, methyl ethyl ketone, cyclohexanone, benzene, toluene, xylene, chloroform, 1,2-dichloroethane, 1,2-dichloropropane, 1,1,2-trichloroethane, 1,1,1-trichloroethane, trichloroethylene, tetrachloroethane, dichloromethane, tetrahydrofuran, dioxane, methanol, ethanol, isopropanol, ethyl acetate, butyl acetate, dimethyl sulfoxide, methyl cellosolve, etc. The carrier transport layer can be formed in the same way as the carrier generation layer is formed.

While any binder resins may be used in the present invention, it is preferred to use hydrophobic, high-dielectric constant, electrically insulating film-forming high-molecular weight polymers. Such high-molecular weight polymers include but are not limited to the following;

(P-1) polycarbonates;
(P-2) polyesters;
(P-3) methacrylic resins;
(P-4) acrylic resins;
(P-5) polyvinyl chloride;
(P-6) polyvinylidene chloride;
(P-7) polystyrene;
(P-8) polyvinyl acetate;
(P-9) styrene-butadiene copolymer;
(P-10) vinylidene chloride-acrylonitrile copolymer;
(P-11) vinyl chloride-vinyl acetate copolymer;
(C-12) vinyl chloride-vinyl acetate-maleic anhydride compolymer;
(P-13) silicone resins;
(P-14) silicone-alkyd resins;
(P-15) phenol-formaldehyde resin;
(P-16) styrene-alkyd resins;
(P-17) poly-N-vinylcarbazole;
(P-18) polyvinylbutyral; and
(P-19) polyvinylformal.

These binder resins may be used either on their own or as admixtures.

In order to further improve such characteristics as charging performance, cycle life and press life, the photoreceptor of the present invention preferably contains a polycarbonate of the following general formula (D) as the chief component of the binder in at least the topmost part of the light-sensitive layer:

(D)

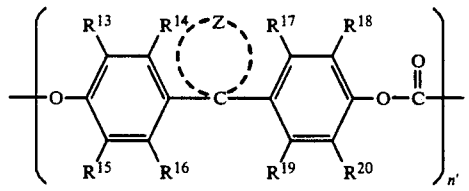

where $R^{13}$, $R^{14}$, $R^{15}$, $R^{16}$, $R^{17}$, $R^{18}$, $R^{19}$ and $R^{20}$ are each independently a hydrogen atom, a halogen atom, a substituted or unsubstituted aliphatic group or a substituted or unsubstituted carbocyclic group; n' is 10–1,000; and Z is the atomic group necessary to form a substituted or unsubstituted carbon ring or a substituted or unsubstituted hereto ring.

The term "topmost part" as used herein means the overlying carrier generation or transport layer in the light-sensitive layer if it is a unitary assembly of superposed carrier generation and transport layers. If the light-sensitive layer is a single layer that contains both the carrier generation material and the carrier transport material as shown in FIG. 6, said light-sensitive layer forms the "topmost part". If a protective layer is formed on the light-sensitive layer, it may contain the polycarbonate resin of the general formula (D) as the chief component of the binder. The expression "as the chief component of the binder" means that at least 50 wt% of the binder contained in the topmost part of the light-sensitive layer is occupied by the polycarbonate of the general formula (D).

In the present invention, it is preferred that at least 50 wt% of the binder contained in the topmost part of the light-sensitive layer is occupied by the polycarbonate of the general formula (D), and the high-molecular weight polymers already described may be used either on their own or in combination as the binder component of layers other than the "topmost part". In this case, too, the polycarbonate of the general formula (D) may be used as the chief component of the binder. It is of course possible to use other binders as the chief component.

Specific examples of the polycarbonate represetned by the general formula (D) are listed below.

(A-1)

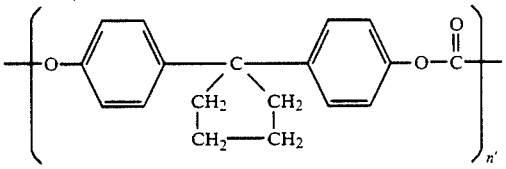

(A-2)

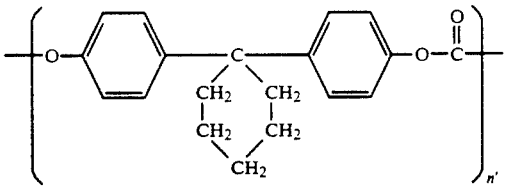

(A-3)

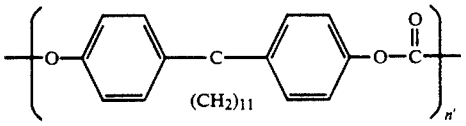

(A-4)

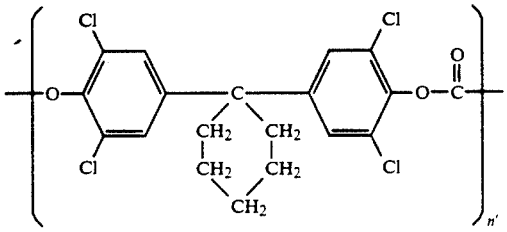

-continued (A-5)

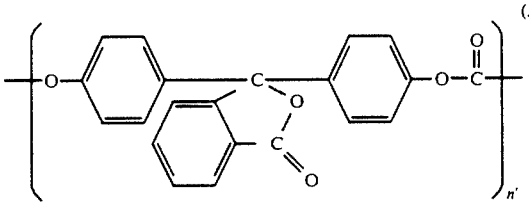

(A-6)

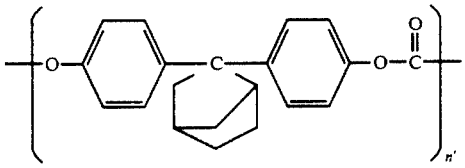

(A-7)

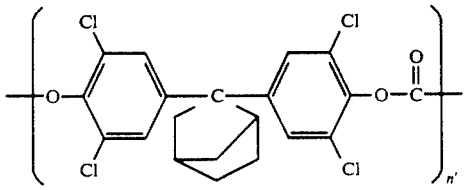

(A-8)

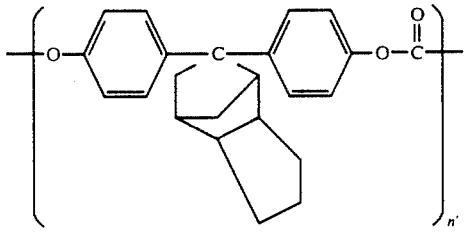

(A-9)

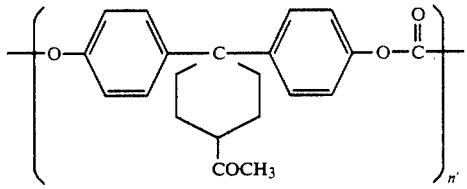

In case where the photoreceptor of the present invention uses a single light-sensitive layer, the weight ratio of the binder to the carrier generation material composed of the bisazo compound of the present invention to the carrier transport material composed of the stilbene compound of the present invention is preferably in the range of (0–100):(1–500):(1–500). If the content of the carrier generation material is less than the lower limit specified above, the light sensitivity decreases whereas the residual potential will increase. If the content of the carrier generation material is greater than the upper limit specified above, both the dark decay and the acceptance potential will decrease.

If the photoreceptor of the present invention uses a light-sensitive layer of a dual structure, the weight ratio of the carrier generation material to the binder is preferably in the range of 100:(0–1,000). If the content of the carrier generation material is less than the lower limit specified above, the light sensitivity will decrease whereas the residual potential will increase. If the content of the carrier generation material is greater than the upper limit specified above, both the dark decay and the acceptance potential will decrease.

The carrier generation layer thus formed preferably has a thickness of 0.01–10 μm, with the range of 0.1–5 μm being particularly preferred.

In the carrier transport layer, the carrier transport material represented by the general formula (II) is preferably contained in an amount of 20–200 parts by weight, more preferably 30–150 parts by weight, per 100 parts by weight of the binder resin in the carrier transport layer.

The carrier transport layer thus formed preferably has a thickness of 5–50 μm, with the range of 5–30 μm being particularly preferred.

The carrier transport materials made of the stilbene compounds of the present invention may be used either on their own or as admixtures. If desired, they may be used together with carrier transport materials other than the stilbene compounds of the present invention on the condition that they should not impair the purposes of the present invention.

Carrier transport materials that can be used in the present invention are by no means limited to any particular compounds but illustrative examples include: aromatic amino compounds, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzimidazole derivatives, quinazoline derivatives, benzofuran derivatives, acridine derivatives, phenazine derivatives, poly-N-vinylcarbazole, poly-1-vinylpyrene, poly-9-vinylanthracene, etc.

Compounds represented by the following general formula (E), (F) or (G) can also be used as carrier transport materials:

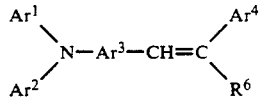

(E)

where $Ar^1$, $Ar^2$ and $Ar^4$ are each independently a substituted or unsubstituted aryl group; $Ar^3$ is a substituted or unsubstituted arylene group; and $R^6$ is a hydrogen atom, a substituted or unsubstituted alkyl group or a substituted or unsubstituted aryl group (for details of the compounds (E), see pages 3 and 4 of Unexamined Published Japanese Patent Application No. 65440/1983 and pages 3–6 of Unexamined Published Japanese Patent Application No. 198043/1983)

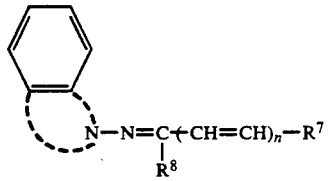

(F)

where $R^7$ is a substituted or unsubstituted aryl group or a substituted or unsubstituted heterocyclic group; $R^8$ is a hydrogen atom, a substituted or unsubstituted alkyl group or a substituted or unsubstituted aryl group (for details of the compounds (F), see Unexamined Published Japanese Patent Application Nos. 134642/1983 and 166354/1983);

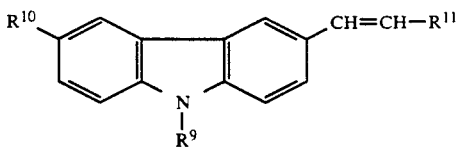

(G)

where $R^9$ is a substituted or unsubstituted aryl group; $R^{10}$ is a hydrogen atom, a halogen atom, a substituted or unsubstituted alkyl group, a substituted or unsubstituted alkoxy group, a substituted or unsubstituted amino group or a hydroxyl group; $R^{11}$ is a substituted or unsubstituted aryl group or a substituted or unsubstituted heterocyclic group (for the methods of synthesizing the compounds (G) and for illustrative examples of these compounds, detailed information is given in Japanese Patent Publication No. 148750/1982 and may be applied to the present invention).

The conductive base support to be used in the photoreceptor of the present invention may be a metal (inclusive of alloys) plate, a metal drum or a thin conductive layer that in made of a conductive polymer, a conductive compound such as indium oxide or a metal (inclusive of alloys) such as aluminum, palladium or gold and which is coated, vapor-deposited, laminated or otherwise formed on a substrate such as paper or a plastic film in order to make them electrically conductive. Intermediate layers such as an adhesive layer or a barrier layer may be made of any of the high-molecular weight polymers cited above as binder resins. Also usable are organic high-molecular weight materials (e.g. polyvinyl alcohol, ethyl cellulose and carboxymethyl cellulose) and aluminum oxide.

Organic amines may be added to the light-sensitive layer in the photoreceptor of the present invention and the addition of secondary amines is preferred. Exemplary secondary amines include: dimethylamine, diethylamine, di-n-propylamine, di-isopropylamine, di-n-butylamine, di-isobutylamine, di-n-amylamine, di-isoamylamine, di-n-hexylamine, di-isohexylamine, di-n-pentylamine, di-isopentylamine, di-n-ocytylamine, di-isooctylamine, di-n-nonylamine, di-isononylamine, di-n-decylamine, di-isodecylamine, di-n-monodecylamine, di-isomonodecylamine, di-n-dodecylamine, di-isododecylamine, etc.

These organic amines are added in amounts that generally do not exceed one mole, preferably 0.2–0.005 moles, per mole of the carrier generation material.

For preventing ozone-induced deterioration, antioxidants may be incorporated in the light-sensitive layer of the photoreceptor of the present invention. The following are typical but by no means limiting examples of antioxidante that can be used in the present invention: Group (I): hindered phenols;

dibutylhydroxytoluene, 2,2'-methylenebis(6-t-butyl-4-methylphenol), 4,4'-butylidenebis (6-t-butyl-3-methylphenol), 4,4'-thiobis (6-t-butyl-3-methylphenol), 2,2'-butylidenebis(6-t-butyl-4-methylphenol), α-tocopherol, β-tocopherol, 2,2,4-trimethyl-6-hydroxy-7-t-butylchroman, pentaerythrityl tetraquis [3-(3,5-di-t-butyl-4-hydroxyphenyl)propionate]2,2'-thiodi-ethylenebis[3-(3,5-di-t-butyl-4-hydroxyphenyl)propionate], 1,6-hexanediolbis[3-(3,5-di-t-butyl-4-hydroxyphenyl) propionate], butylhydroxyanisole, dibutylhydroxyanisole, 1-[2-{(3,5-di-butyl-4-hydroxyphenyl)propionyloxy)e-thyl]-4[3-(3,5-di-butyl-4-hydroxyphenyl)propionyl-oxy[-2,2,6,6tetramethylpiperidy;

Group (II): paraphenylenediamines;

N-phenyl-N'-isopropyl-p-phenylenediamine, N,N'-di-sec-butyl-p-phenylenediamine, N-phenyl-N-sec-butyl-p-phenlenedimamine, N,N'-diisopropyl-p-phenylenediamine, and N,N'-dimethyl-N-N'-di-t-butyl-p-phenylenediamine; Group (III), hydroquinones:

2,5-di-t-octylhydroquinone, 2,6-didodecylhydroquinone, 2-dodecylhydroquinone, 2-dodecyl-5chlorohydroquinone, 2-t-octyl-5-methylhydroquinone, and 2-(2-octadecenyl)-5-methylhydroquinone;

Group (IV): organosulfur compounds;

dilauryl-3-3'-thiodipropionate, distearyl-3,3'-thiodipropionate and ditetradecyl-3,3'-thiodipropionate; and Group (V): organophosphorus compounds;

triphenylphosphine, tri(nonylphenyl)phosphine, tri(-dinonyl-phenyl)phosphine, tricresylphosphine, and tri(2,4-dibutylphenoxy)-phosphine.

The compounds described above are known as antioxidants for use in rubbers, plastics, fats & oils, etc. and are commercially available on the market.

The antioxidants described above may be incorporated in the carrier transport layer. In this case, they are added in amounts ranging from 0.1 to 100 parts by weight, preferably from 1 to 50 parts by weight, more preferably from 1 to 25 parts by weight, per 100 parts by weight of the carrier transport material.

In order to improve sensitivity or reduce residual potential or fatigue due to cyclic use, the carrier generation layer of the photoreceptor of the present invention may contain one or more electron-accepting materials. Useful electron-accepting materials are selected from among the following compounds having high electron affinity; succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinone chlorimide, chloranil, bromanil, dichlorodicyano-p-benzoquinone, anthraquinone, dinitroanthraquinone, 2,7-dinitrofluorenone, 2,4, 7-trinitrofluorenone, 2,4,5,7-tetranitrofluorenone, 9-fluorenylidene (dicyano-methylene malonodinitrile), polynitro-9-fluorenylidene-(dicyanomethylene malonodinitrile), picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, and mellitic acid.

These electron-accepting materials are used in such amounts that the weight ratio of carrier generation material to electron-accepting material is in the range of from 100:0.01 to 100:200, preferably from 100:0.1 to 100:100.

The electron-accepting materials may also be incorporated in the carrier transport layer. In this case, they are used in such amounts that the weight ratio of carrier transport material to electron-accepting material is in the range of from 100:0.01 to 100:100, preferably from 100:0.1 to 100:50.

If necessary, the photoreceptor of the present invention may contain additives such as an ultraviolet absorber in order to protect the light-sensitive layer. It may also contain dyes capable of color sensitivity correction.

The photoreceptor of the present invention has satisfactory sensitivity of visible rays of light. Illustrative light sources that emit in this wavelength range include a halogen lamp, a fluorescent lamp, a tungsten lamp, and gas lasers such as an argon laser and a He-Ne laser.

The following examples are provided for the purpose of further illustrating the present invention but are in no way to be taken as limiting.

EXAMPLE 1

Five grams of a polyamide resin ("Lakkamide 5003" of Dainippon Ink & Chemicals, Inc.) was dissolved in a mixed solvent of methanol (80 ml) and butanol (20 ml) to form a coating solution for intermediate layer. This solution was wire-bar coated onto an Al-evaporated polyester base and dried to form an intermediate layer having a thickness of ca. 0.5 μm.

A carrier generation material CGM 2 (8 g of polycyclic quinone compound A3) and another carrier generation material CGM 1 (0.4 g of bisazo compound No. 54) were mixed in a solution having 2 g of a polyvinyl butyral resin ("ES-lec BX-1") of Sekisui Chemical Co., Ltd.) dissolved in 100 ml of 1,2-dichloroethane and the mixture was dispersed with a sand grinder for 10 h to prepare a coating solution for carrier generation layer. This solution was wire-bar coated onto the intermediate layer and dried to form a carrier generation layer in a thickness of ca. 0.3 μm.

A Coating solution for carrier transport layer was prepared to the formula shown below and was blade-coated onto the carrier generation layer and dried to form a carrier transport layer in a thickness of ca. 20 μm.

| Coating solution for carrier transport layer | |
|---|---|
| 1,2-dichloroethane | 100 ml |
| Polycarbonate resin ("Jupilon Z-200" of Mitsubishi Gas Chemical Co., Inc.) | 15 g |
| Stilbene compound No. 92 | 12 g |

The so fabricated photoreceptor was designated sample No. 1.

Sample Nos. 2–7 were fabricated by repeating the same procedure except that the carrier generation material and its content were changed as shown in Table 1.

The following tests were conducted in order to evaluate the characteristics of sample Nos. 1–7.

Sensitivity test

Using a paper analyzer Model EPA-8100 of Kawaguchi Electric Works Co., Ltd., the half-decay exposure El/2 (lux·sec) necessary for the initial surface potential of each sample to decrease by half was measured.

Cycle life test

Using the same paper analyzer EPA-8100, 100 cycles of charging, exposure and erasure steps were repeated and the change in charging potential from the first to the 100th cycles, $\Delta V^{0\rightarrow 100}$ (volts) was measured.

Red color reproduction test

Using a copier with a surface potentiometer as adapted from an electrophotographic copier, U-Bix 1550, of Konica Corp., copying was made on Kodak color control patches with a black paper potential and a white paper potential adjusted to −600 V and −100 V, respectively. The surface potential, Vred (V), on each sample which corresponded to the red patch was measured. The lower the value of Vred, the poorer the reproducibility of the red image.

Endurance test

Using the same electrophotographic copier, the endurance of each sample was tested by repeating 20,000 cycles of charging, exposure and erasure steps. Measurements were conducted on the position of development following exposure, and the amount of increase in the potential of white paper, $\Delta v_w 2000$, was evaluated. The greater the value of this increase, the less durable the sample was.

The test results are shown in Table 1.

TABLE 1

| | Sample No. | Carrier generation material CGM 1 | CGM 2 | Weight ratio of CGM 1/CGM 2 | $E_{\frac{1}{2}}$, lux · sec | $\Delta V^{0\to100}$ V | Vred V | $\Delta Vw^{20000}$ V |
|---|---|---|---|---|---|---|---|---|
| Sample of the invention | 1 | No. 54 | A3 | 2.5/100 | 1.3 | −5 (610→605) | 520 | 0 |
| | 2 | No. 54 | A3 | 5/100 | 1.2 | −15 (605→590) | 500 | 0 |
| | 3 | No. 54 | A3 | 10/100 | 1.1 | −20 (620→600) | 450 | 0 |
| | 4 | No. 54 | A3 | 20/100 | 0.9 | −20 (615→595) | 400 | 0 |
| | 5 | No. 54 | A3 | 30/100 | 0.9 | −20 (630→610) | 380 | 5 |
| Comparative samples | 6 | No. 54 | — | — | 1.1 | −35 (610→575) | 300 | 20 |
| | 7 | Comparative azo compound (A) | A3 | 5/100 | 2.2 | −40 (610→570) | 460 | 5 |

*Comparative azo compound (A).

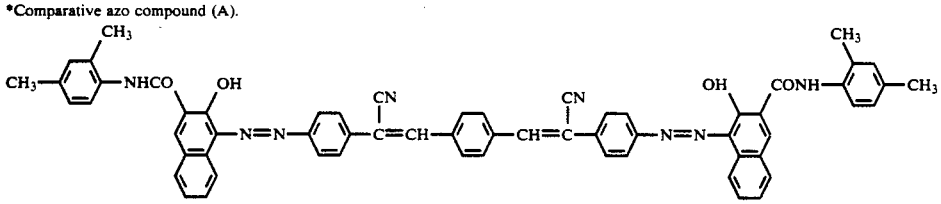

The data in Table 1 shows that the photoreceptor samples of the present invention had better performance than the comparative samples in all aspects including sensitivity, reproduction of red image upon copying, cycle life and endurance.

EXAMPLE 2

Photoreceptor sample Nos. 8–12 were fabricated as in Example 1 except that compound No. 93 was used as a carrier transport material and that the combination of carrier generation materials was changed to those listed in Table 2. The results of evaluation conducted as in Example 1 are also shown in Table 2.

TABLE 2

| | Sample No. | Carrier generation material CGM 1 | CGM 2 | Weight ratio of CGM 1/CGM 2 | $E_{\frac{1}{2}}$, lux · sec | $\Delta V^{0\to100}$ V | Vred V | $\Delta Vw^{20000}$ V |
|---|---|---|---|---|---|---|---|---|
| Samples of the invention | 8 | No. 83 | A3 | 2.5/100 | 1.5 | −10 (610→600) | 550 | 0 |
| | 9 | No. 83 | A3 | 5/100 | 1.3 | −10 (625→615) | 530 | 0 |
| | 10 | No. 83 | A3 | 10/100 | 1.1 | −15 (630→615) | 480 | 0 |
| Comparative samples | 11 | No. 83 | — | — | 1.5 | −40 (600→560) | 300 | 25 |
| | 12 | Comparative azo compound (A) | A3 | 5/100 | 2.4 | −40 (595→555) | 460 | 5 |

The data in Table 2 shows that the photoreceptor samples of the present invention had better performance than the comparative samples in all aspects including sensitivity, reproduction of red image upon copying, cycle life and endurance.

EXAMPLE 3

Additional photoreceptor sample Nos. 13–17 were fabricated as in Example 1 except that the carrier generation material CGM 2 was changed to those shown in Table 3. The results of evaluation conducted as in Example 1 are also shown in Table 3.

TABLE 3

| | Sample No. | Carrier generation material CGM 1 | CGM 2 | Weight ratio of CGM 1/ CGM 2 | $E_{\frac{1}{2}}$, lux · sec | $\Delta V^{0\rightarrow 100}$ V | Vred V | $\Delta V_{10}$20000 V |
|---|---|---|---|---|---|---|---|---|
| Samples of the invention | 13 | No. 54 | C3 | 2.5/100 | 1.4 | −5 (590→585) | 540 | 0 |
| | 14 | No. 54 | C3 | 5/100 | 1.2 | −5 (640→635) | 510 | 0 |
| | 15 | No. 54 | C3 | 10/100 | 1.0 | −15 (600→585) | 450 | 0 |
| | 16 | No. 54 | C3 | 20/100 | 1.0 | −15 (595→580) | 430 | 5 |
| Comparative samples | 17 | Comparative azo compound (A) | C3 | 5/100 | 2.3 | −35 (620→585) | 450 | 5 |

The data in Table 3 shows that the photoreceptor samples of the present invention had better performance than the comparative samples in all aspects including sensitivity, reproduction of red image upon copying, cycle life and endurance.

What is claimed is:

1. A photoreceptor having a light-sensitive layer that contains as carrier generation material a polycyclic quinone compound represented by the following general formula (A), (B) or (C) asnd a compound represented by the following general formula (i) and that also contains a compound represented by the following general formula (II) as a carrier transport material:

(A)

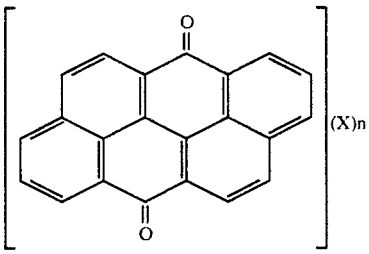

(B)

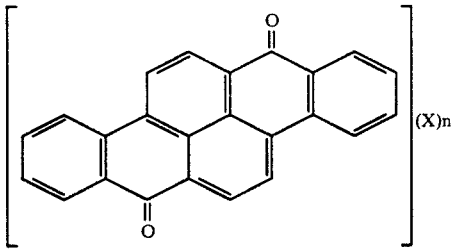

(C)

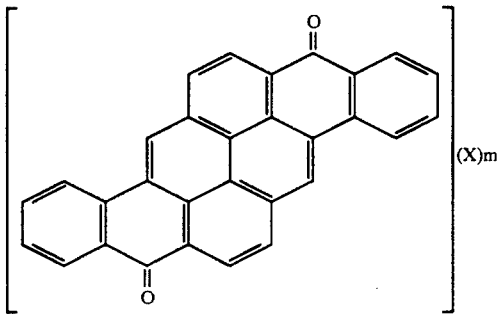

(where X is a halogen atom, a nitro group, a cyano group, an acyl group or a carboxyl group; n is an integer of 0–4; and m is an integer of 0–6);

[I]

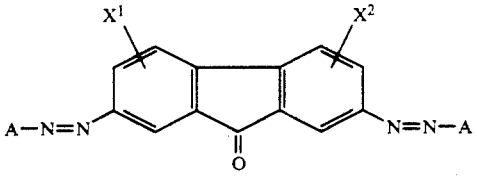

(where $X^1$ and $X^2$ independently are a hydrogen atom or a halogen atom, provided that $X^1$ and $X^2$ are not simultaneously a hydrogen atom; A is a group represented by formula [P];

[P]

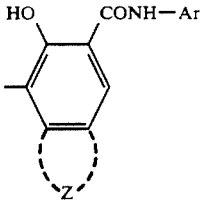

(wherein Ar is an aromatic hydrocarbon ring having a fluorinated hydrocarbon group or an aromatic heterocyclic group having a fluorinated hydrocarbon group; Z is a group of non-metal atoms necessary to complete a substituted or unsubstituted aromatic group or a substituted or unsubstituted aromatic heterocyclic group);

(II)

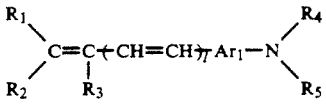

(where $R_1$ is a substituted or unsubstituted aryl or styryl group; $R_2$ is a hydrogen atom, a substituted or unsubstituted alkyl group, a substituted or unsubstituted aryl group or a substituted or unsubstituted styryl group, provided that $R_1$ and $R_2$ may combine together to form a ring; $Ar_1$ is a substituted or unsubstituted arylene group; $R_3$, $R_4$ and $R_5$ are each independently a hydrogen atom, a substituted or unsubstituted alkyl group, a substituted or unsubstituted aryl group or a substituted or unsubstituted styryl group; l is an integer of 0 or 1, provided that when l=0 and $R_1$ is a substituted or unsubstituted aryl group, $R_2$ is a substituted or unsubstituted alkyl group, a substituted or unsubstituted aryl group or a substituted or unsubstituted styryl group).

2. A photoreceptor according to claim 1 wherein at least one of $X^1$ and $X^2$ in the general formula (I)1 is a halogen atom.

3. A photoreceptor according to claim 1 wherein the compound represented by the general formula (I) is at least one of the compounds represented by the following general formulas (III) and (IV):

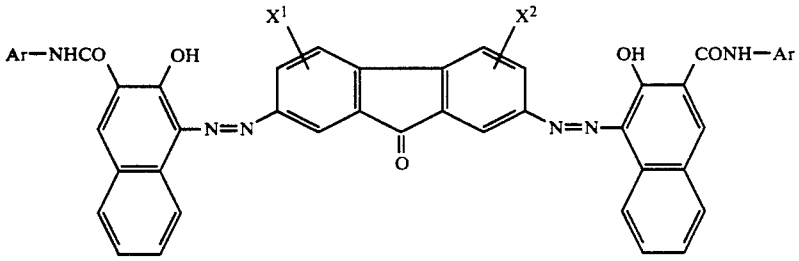

(III)

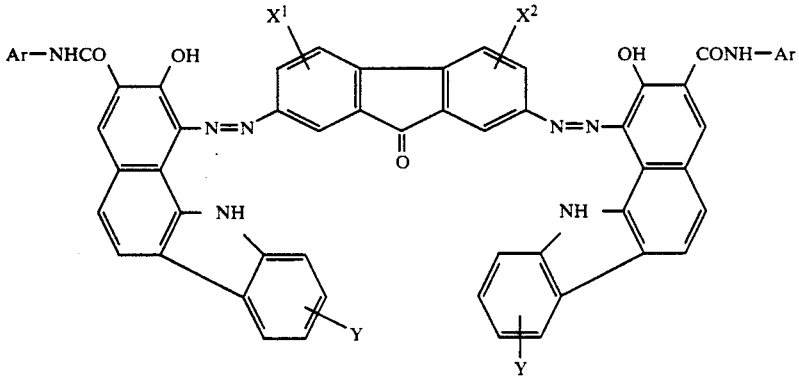

(IV)

where $X^1$ and $X^2$ respectively have the same meanings as $X^1$ and $X^2$ in the general formula (I), and Ar and Y respectively have the same meanings as Ar and the substituent on Z in the general formula (P).

4. A photoreceptor according to claim 1 wherein the proportions of the polycyclic quinone compound and the compound of the general formula (I) in the light-sensitive layer are such that the weight ratio of the former to the latter is in the range of from (100:1) to (100:100).

5. A photoreceptor according to claim 1 wherein the proportions of the polycyclic quinone compound and the compound of the general formula (I) in the light-sensitive layer are such that the weight ratio of the former to the latter is in the range of from (100:1) to (100:20).

6. A photoreceptor according to claim 1 wherein each of $R_1$, $R_2$, $R_4$ and $R_5$ in the general formula (II) is an aryl group.

7. A photoreceptor according to claim 1 wherein the ratio of Qmax ($\lambda \leqq 600$ nm) to Qmax ($\lambda \geqq 600$ nm) is not more than 100:50, where Qmax ($\lambda \leqq 600$ nm) is a maximum spectral sensitivity in the wavelength range not longer than 600 nm and Qmax ($\lambda \geqq 600$ nm) is a maximum spectral sensitivity in the wavelength range not shorter than 600 nm.

8. A photoreceptor according to claim 1 wherein said light-sensitive layer is a unitary assembly of a carrier generation layer containing the polycyclic quinone compound and the compound of the general formula (I) as carrier generation materials, and a carrier transport layer containing the compound of the general formula (II) as a carrier transport material.

9. A photoreceptor according to claim 8 wherein the weight ratio of the carrier generation material to the binder in said carrier generation layer is in the range of 100:(0-1,000).

10. A photoreceptor according to claim 8 wherein said carrier generation layer has a thickness of 0.01-10 μm.

11. A photoreceptor according to claim 8 wherein the carrier transport material is contained in said carrier transport layer in an amount of 20-200 parts by weight per 100 parts by weight of the binder.

12. A photoreceptor according to claim 8 wherein said carrier transport layer has a thickness of 5-50 μm.

13. A photoreceptor according to claim 1 wherein said light-sensitive layer is a single layer.

14. A photoreceptor according to claim 13 wherein the weight ratio of the binder to carrier generation material to carrier transport material in said light-sensitive layer is in the range of (0-100):(1-500):(1-500).

15. A photoreceptor according to claim 1 wherein a polycarbonate represented by the following general formula (D) is contained in at least the topmost part of the lightsensitive layer:

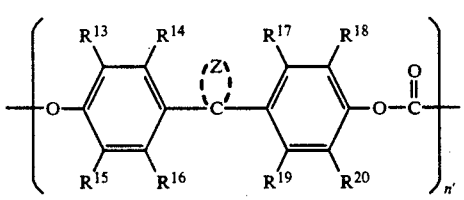

(D)

where $R^{13}$, $R^{14}$, $R^{15}$, $R^{16}$, $R^{17}$, $R^{18}$, $R^{19}$ and $R^{20}$ are each independently a hydrogen atom, a halogen atom, a substituted or unsubstituted aliphatic group or substituted or unsubstituted carbocyclic group; n' is 10-1,000; and Z is the atomic group necessary to form a substituted or unsubstituted carbon ring or a substituted or unsubstituted hetero ring.

* * * * *